US009840079B2

(12) United States Patent
Kobayashi et al.

(10) Patent No.: US 9,840,079 B2
(45) Date of Patent: Dec. 12, 2017

(54) RECORDING APPARATUS

(71) Applicant: SEIKO EPSON CORPORATION, Tokyo (JP)

(72) Inventors: Takumi Kobayashi, Matsumoto (JP); Soshi Okawa, Shiojiri (JP); Shoma Kudo, Shiojiri (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/977,695

(22) Filed: Dec. 22, 2015

(65) Prior Publication Data

US 2016/0207335 A1 Jul. 21, 2016

(30) Foreign Application Priority Data

Jan. 19, 2015 (JP) ..... 2015-007481
Jan. 19, 2015 (JP) ..... 2015-007482

(51) Int. Cl.

| | |
|---|---|
| ***B41J 23/00*** | (2006.01) |
| ***B41J 2/175*** | (2006.01) |
| ***B41J 29/02*** | (2006.01) |
| ***B41J 29/13*** | (2006.01) |

(52) U.S. Cl.

CPC ..... *B41J 2/175* (2013.01); *B41J 29/02* (2013.01); *B41J 29/13* (2013.01)

(58) Field of Classification Search

None

See application file for complete search history.

(56) References Cited

U.S. PATENT DOCUMENTS

2006/0028519 A1* 2/2006 Nakamura ..... B41J 2/17523 347/87
2006/0192833 A1* 8/2006 Samoto ..... B41J 29/02 347/108
2006/0244799 A1* 11/2006 Sasa ..... B41J 2/16523 347/89

FOREIGN PATENT DOCUMENTS

JP 2012-152994 A 8/2012

OTHER PUBLICATIONS

Shimizu, Yoshiaki, Ink Supply Device and Ink Jet Recorder, Mar. 29, 2012, Seiko Epson, JP 2012-061624; pp. 1-24.*
Shimizu, Yoshiaki, Ink Supply Devie and Ink Jet Recorder, Mar. 29, 2012, Seiko Epson, JP 2012-061624; pp. 1-24.*

* cited by examiner

*Primary Examiner* — Matthew Luu
*Assistant Examiner* — Tracey McMillion
(74) *Attorney, Agent, or Firm* — Workman Nydegger

(57) ABSTRACT

A recording apparatus includes a carriage which is capable of moving along a first direction, a first sliding section that is provided in the carriage, on one side in a second direction, which intersects the first direction, a second sliding section that is provided, in an arm section, which extends from the other side, protruding in the second direction, a tube that supplies the liquid, which is delivered from a liquid accommodation section, to the carriage, extends in a direction that intersects the second direction by extending out from the carriage, and extends in an opposite direction by turning back in a vertical direction, in which the tube extends in the direction that intersects the second direction by passing at least one of above and below the arm section.

15 Claims, 23 Drawing Sheets

RECORDING APPARATUS

BACKGROUND

1. Technical Field

The present invention relates to a recording apparatus that performs recording on a target recording medium.

In the present application, the term recording apparatus includes serial printers, in which a recording head performs recording while moving in a predetermined direction, and recording apparatus types such as copy machines and facsimiles that are provided with such printing functions.

2. Related Art

In recent years, in recording apparatuses such as ink jet printers, large capacity ink accommodation tanks have been provided either inside an apparatus main body or outside the apparatus main body in order to improve a number of sheets of a target recording medium on which recording is possible. JP-A-2012-152994 discloses an example of a recording apparatus that is provided with such a large capacity ink accommodation tank.

The recording apparatus that is disclosed in JP-A-2012-152994 is configured so that a carriage, which is inserted onto a carriage guide shaft, is capable of reciprocating motion in an apparatus width direction. In addition, in the carriage, an upper section of the carriage is supported by a guide frame that extends in the apparatus width direction.

In the recording apparatus that is disclosed in JP-A-2012-152994, a plurality of large capacity ink tanks are provided on a side surface of the apparatus main body, and ink tubes are connected to the ink tanks. The ink tubes that are connected to the ink tanks extend in the apparatus width direction, and are configured to include a turnback portion on the left side of the carriage in the apparatus width direction with respect to the reciprocating motion of the carriage in the apparatus width direction, and to deform following the reciprocating motion.

Given that, increases in the density of nozzles in recording heads, which are provided in carriages, have been achieved for recent improvements in the recording quality on target recording media. More specifically, in the abovementioned recording head, the number of nozzles that discharge an ink onto the target recording medium has been increased.

However, in the abovementioned recording head, if the number of nozzles is increased, a required supply amount of the ink to the recording head also increases. Therefore, the diameters of the ink tubes that supply the ink from the ink tank to the carriage, are increased. When a recording head in which the number of nozzles has been increased, is applied to the recording apparatus that is disclosed in JP-A-2012-152994, since the diameters of the ink tubes are large, a tube bending reaction force that occurs in the turnback portion is increased.

In this instance, there are cases in which the tube bending reaction force is greater than the dead weight of the carriage. As a result of this, the tube bending reaction force acts in a manner that separates the carriage from the guide frame, and there is a concern that the recording quality on the target recording medium will deteriorate as a result of shifting of impact positions of the ink that is discharged from the recording head, occurring.

SUMMARY

An advantage of some aspects of the invention is to provide a recording apparatus in which the recording quality on a target recording medium is improved by stabilizing the posture of the carriage.

The invention can be realized in the following aspects or application examples.

Application Example 1

According to this application example, there is provided a recording apparatus includes a recording head that performs recording by discharging a liquid onto a target recording medium, a carriage, on which the recording head is provided, and which is capable of moving along a first direction, a first sliding section that is provided in the carriage, on one side in a second direction, which intersects the first direction, a second sliding section that is provided in the carriage, in an arm section, which extends from the other side in the second direction, protruding in the second direction, a first guide member that extends in the first direction and supports the carriage by coming into contact with the first sliding section, and guides movement of the carriage, a second guide member that extends in the first direction, is disposed at an interval from the first guide member in the second direction, supports the carriage by coming into contact with the second sliding section, and guides the movement of the carriage, a liquid accommodation section that accommodates the liquid, and a tube, which is a tube that supplies the liquid, which is delivered from the liquid accommodation section, to the carriage, extends in a direction that intersects the second direction by extending out from the carriage, and extends in an opposite direction by turning back in a vertical direction, in which the tube extends in the direction that intersects the second direction by passing at least one of above and below the abovementioned arm section.

In the present specification, in addition to the first direction, which is an apparatus width direction, the term "direction that intersects the second direction" includes directions that extend diagonally along the apparatus width direction inclined in an apparatus depth direction, which is the second direction, and directions that extend diagonally in an apparatus height direction.

According to the application example, the carriage is supported by the first guide member and the second guide member, which are disposed at an interval in the second direction, the tube that supplies the liquid, which is delivered from the liquid accommodation section, to the carriage, extends in a direction that intersects the second direction by extending out from the carriage, extends in an opposite direction by turning back in a vertical direction, and extends in the direction that intersects the second direction between the first sliding section and the second sliding section in the second direction. In this instance, a restoring force that attempts to make the curve gentle, in other words, attempts to restore the tube to a state of being extended in a straight manner, occurs in the tube. Further, the restoring force acts on the carriage, which the tube is connected to, and, for example, attempts to separate the first sliding section and the second sliding section from the first guide member or the second guide member by lifting the carriage up.

In addition, the restoring force brings about a moment force that attempts to rotate the carriage with the first sliding section as a pivot point. The moment force becomes proportionately larger with distance from the first sliding section to the tube.

In the application example, since the tube extends in a direction that intersects the second direction between the first sliding section and the second sliding section in the second direction, a distance between the tube and the first sliding section in the second direction is shorter than a distance between the first sliding section and the second sliding section. In other words, it is possible to make distance between the tube and the first sliding section shorter than in a case in which the tube is disposed on an outer side of the second sliding section with respect to the first sliding section. As a result of this, the moment force in a case in which the tube is positioned between the first sliding section and the second sliding section can be smaller than the moment force in a case in which the tube is disposed on an outer side of the second sliding section with respect to the first sliding section.

As a result of this, it is possible to suppress the separation of the carriage from the first guide member or the second guide member. Therefore, since it is possible to stabilize the posture of the recording head, and furthermore, the carriage with respect to the target recording medium, it is possible to suppress deteriorations in the recording quality on the target recording medium.

In addition, according to the application example, the second sliding section is provided in the arm section which extends by protruding out from the carriage in the second direction, and the tube extends in a direction that intersects the second direction passing at least one of above and below the arm section. Accordingly, in the application example, it is possible to make the distance between the first sliding section and the second sliding section in the second direction longer. As a result of this, it is possible to increase a moment force due to the dead weight of the carriage, which acts on the second sliding section, and of which the first sliding section is a pivot point. As a result of this, it is possible to suppress the separation of the carriage from the first guide member or the second guide member, and therefore, it is possible to suppress deteriorations in recording quality as a result. In addition, since inclination of the carriage with the first direction as a rotational axis thereof is reduced if the distance of the arm section is increased, it is possible to maintain the recording quality on the target recording medium in the recording head.

Application Example 2

In the recording apparatus, it is preferable that the first sliding section retains the carriage in the second direction by the first guide member being inserted between the carriage and the first sliding section in the second direction, the second sliding section is supported from below by the second guide member, and the tube is disposed in a position at which a distance from the first sliding section in the second direction is longer than a distance from the second sliding section.

According to the application example, since the first sliding section retains the carriage in the second direction by the first guide member being inserted between the carriage and the first sliding section in the second direction, it is possible to regulate displacement of the carriage in the second direction when the carriage moves in the first direction as a result of being guided by the first guide member, and therefore, it is possible to suppress deteriorations in the recording quality as a result.

Application Example 3

In the recording apparatus, it is preferable that the tube is connected to the carriage above the arm section as a result of curving and turning back passing below the arm section.

According to the application example, since the tube is connected to the carriage above the arm section as a result of curving and turning back passing below the arm section, it is possible to increase a curvature radius of the tube. As a result of this, it is possible to reduce the restoring force that attempts to make the curve, which occurs in the tube, gentle. As a result of this, it is possible to more reliably suppress a circumstance in which the restoring force resists the dead weight of the carriage and attempts to separate the carriage from the first guide member or the second guide member. Therefore, it is possible to suppress deteriorations in the recording quality on the target recording medium as a result.

Application Example 4

In the recording apparatus, it is preferable that the first sliding section is provided in a lower section of the carriage.

Application Example 5

In the recording apparatus, it is preferable that a distance between the tube and the first sliding section in the second direction is shorter than the distance between the first sliding section and the second sliding section.

According to the application example, a distance between the tube and the first sliding section in the second direction is shorter than the distance between the first sliding section and the second sliding section. Accordingly, it is possible to make the moment force that occurs in the carriage smaller than a moment force due to the dead weight of the carriage, which acts on the second sliding section. As a result of this, it is possible to suppress the separation of the carriage from the second guide member. Therefore, it is possible to suppress deteriorations in the recording quality on the target recording medium as a result.

Application Example 6

It is preferable that the recording apparatus further includes a regulation unit that is provided in the arm section, and regulates separation of the second sliding section from the second guide member.

According to the application example, since the regulation unit, which regulates separation of the second sliding section from the second guide member, is provided in the arm section, which extends by protruding out from the carriage in the second direction, the distance between the first sliding section and the regulation unit in the second direction is longer, and therefore, it is even possible to counter the moment force that occurs in the carriage with a small force. Accordingly, the regulation unit can easily suppress the separation of the second sliding section from the second guide member. As a result of this, since the posture of the recording head, and furthermore, the carriage with respect to the target recording medium is stabilized, it is possible to suppress deteriorations in the recording quality on the target recording medium.

In addition, according to the application example, since the second sliding section is provided in the arm section, the regulation unit can reliably regulate a circumstance in which the second sliding section becomes separated from the second guide member in the vicinity of the second sliding section. Therefore, since the posture of the recording head, and furthermore, the carriage is stabilized with respect to the target recording medium, it is possible to suppress deteriorations in the recording quality on the target recording medium.

Application Example 7

In the recording apparatus, it is preferable that the second guide member further includes a support section that supports by coming into contact with the second sliding section, and a facing section that is provided above the support section, and faces the support section, and the regulation unit is provided with a third sliding section that comes into contact with the facing section and is capable of sliding.

According to the application example, the third sliding section comes into contact with the facing section in the regulation unit. In other words, the regulation unit regulates displacement of the carriage with respect to a direction in which the second sliding section becomes separated from the second guide member with the first sliding section as a pivot point thereof, by causing the third sliding section to come into contact with the facing section. Accordingly, since the regulation unit can more reliably counter the moment force, and the posture of carriage is stabilized as a result, it is possible to suppress deteriorations in the recording quality on the target recording medium.

Application Example 8

In the recording apparatus, it is preferable that the regulation unit further includes a biasing member that biases the third sliding section toward the facing section.

According to the application example, the regulation unit includes a biasing member that biases the third sliding section toward the facing section. In other words, since the biasing member biases the third sliding section toward the facing section, the third sliding section is subjected to a reaction force, which acts in a direction that is opposite to a direction in which the moment force acts from the facing section. Accordingly, since the reaction force in the carriage acts in a direction in which the moment force decreases, the regulation unit reliably stabilizes the posture of the carriage, and therefore, it is possible to suppress deteriorations in the recording quality on the target recording medium.

Application Example 9

In the recording apparatus, it is preferable that the regulation unit further includes a magnetic member, and the magnetic member draws the second guide member to a second sliding section side using a magnetic force.

According to the application example, since the regulation unit is a magnetic member that draws the second guide member to a second sliding section side, the second guide member is attracted to the second sliding section side by the magnetic force of the magnetic member. As a result of this, since the magnetic force of the magnetic member counters the moment force, displacement in the second sliding section in a direction that becomes separated from the second guide member is suppressed, and therefore, it is possible to suppress deteriorations in the recording quality on the target recording medium since the posture of the carriage is stabilized.

Application Example 10

In the recording apparatus, it is preferable that a plurality of the tubes are provided, in the tubes, turnback portions, which curve, follow the movement of the carriage in the first direction, a tube diameter conversion member is provided in a position that is shifted from a movement region of the turnback portions in the first direction, and a tube diameter from the liquid accommodation section to the tube diameter conversion member is greater than a tube diameter from the tube diameter conversion member to the carriage through the turnback portions.

According to the application example, a tube diameter from the liquid accommodation section to the tube diameter conversion member is greater than a tube diameter from the tube diameter conversion member to the carriage through the turnback portions. In other words, the diameter of the tube from the liquid accommodation section to the tube diameter conversion member is wide, and the diameter of the tube from the tube diameter conversion member to the carriage is narrow. Therefore, in comparison with a case in which the tube diameter is narrow throughout the entire pathway from the liquid accommodation section to the carriage, it is possible to reduce pressure loss by making the tube diameter in the pathway from the liquid accommodation section to the tube diameter conversion member wide, and therefore, it is possible to suppress nozzle slip-out in the recording head.

In addition, in the application example, since the diameter of the tube from the tube diameter conversion member to the carriage is narrow, that is, the tube diameter of a portion that corresponds to operation of the carriage is narrow, it is possible to reduce a reaction force of the tube that is transmitted to the carriage, and therefore, it is possible to maintain the recording quality on the target recording medium in the recording head.

Application Example 11

In the recording apparatus, it is preferable that a plurality of the tubes are arranged along the second direction, and a diameter of a tube that is closest to the first sliding section in the second direction is greater than those of the other tubes.

According to the application example, among a plurality of tubes that are arranged in the second direction, a tube that is arranged closest to the first sliding section is wider than the other tubes. In this instance, the restoring force that attempts to make the curve, which occurs in the tube, gentle becomes larger as the diameter of the tube becomes wider. Accordingly, in the application example, a tube with the largest restoring force is disposed close to the first sliding section, but since it is possible to make a distance between the tube with the largest restoring force and the first sliding section smaller, it is possible to reduce the moment force that attempts to rotate the carriage with the first sliding section as the pivot point thereof. Accordingly, it is possible to suppress a circumstance in which the carriage attempts to become separated from the second guide member. As a result of this, it is possible to suppress deteriorations in the recording quality on the target recording medium.

Application Example 12

In the recording apparatus, it is preferable that the liquid is ink, and the tube with the widest diameter supplies black ink to the recording head.

According to the application example, the tube with the widest diameter supplies black ink to the recording head. In this instance, in the recording apparatus, ink of a plurality colors, for example, black, cyan, magenta, yellow, and the like, is used, but the usage amount of black ink is the highest. In the application example, it is possible to supply the black ink to the recording head from the liquid accommodation section in the tube with the widest diameter among the plurality of tubes. In other words, since it is possible to increase the supply amount of black ink to the recording head, for which the usage amount is highest, it is possible to stabilize the supply of black ink to the recording head.

Application Example 13

In the recording apparatus, it is preferable that a plurality of the liquid accommodation sections are provided along the second direction, among the plurality of liquid accommodation sections that are provided, at least a part of a liquid accommodation section that is positioned closest to the second sliding section in the second direction, and at least a part of the tube with the widest tube diameter are in the same position in the second direction, and the liquid accommodation section that is positioned closest to the second sliding section is connected to the tube with the widest tube diameter.

According to the application example, among the plurality of liquid accommodation sections that are provided, at least a part of a liquid accommodation section that is positioned closest to the second sliding section along the second direction, and at least a part of the tube with the widest tube diameter are in the same position in the second direction, and the liquid accommodation section that is positioned closest to the second sliding section is connected to the tube with the widest tube diameter. In other words, it can be said that the distance in the second direction between the liquid accommodation section that is positioned closest to the second sliding section and the tube with the widest tube diameter is shorter than the distance between the other liquid accommodation sections and the other tubes. Accordingly, a pathway length from the liquid accommodation section that is positioned closest to the second sliding section to the carriage in the tube with the widest tube diameter can be made shorter than a pathway length from other liquid accommodation sections to the carriage in the other tubes.

Application Example 14

It is preferable that the recording apparatus further includes a tube guide member that extends along the first direction, and guides the tube, and in the recording apparatus, the tube guide member is arranged below the arm section.

Application Example 15

It is preferable that the recording apparatus further includes a retaining member that extends along the first direction, and retains an ejection roller, which ejects the target recording medium, and in the recording apparatus, the tube guide member and the retaining member are separated.

According to the application example, since the tube guide member and the retaining member are separated, the retaining member is not subjected to the restoring force, which attempts to make the curve that occurs in the tube gentle, via the tube guide member, and therefore, it is possible to suppress a circumstance in which the retaining member becomes warped as a result of being subjected to the restoring force. As a result of this, since it is possible to suppress a circumstance in which the retaining member becomes warped, it is possible to suppress deteriorations in an ejection property of the target recording medium since it is difficult for positional shift of the ejection roller due to warping of the retaining member to occur.

Application Example 16

In the recording apparatus, it is preferable that the arm section extends in a lower section of the carriage protruding in the second direction from a center of the carriage in the first direction, and a tip end thereof extends downward.

According to the application example, since the second sliding section is provided in the arm section, which extends from the carriage in the second direction, it is possible to make the distance between the first sliding section and the second sliding section in the second direction longer without increasing the size of the carriage. As a result of this, an increase in the size of the carriage is suppressed, and therefore, it is possible to reduce the size of the carriage and it is possible to achieve a reduction in cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
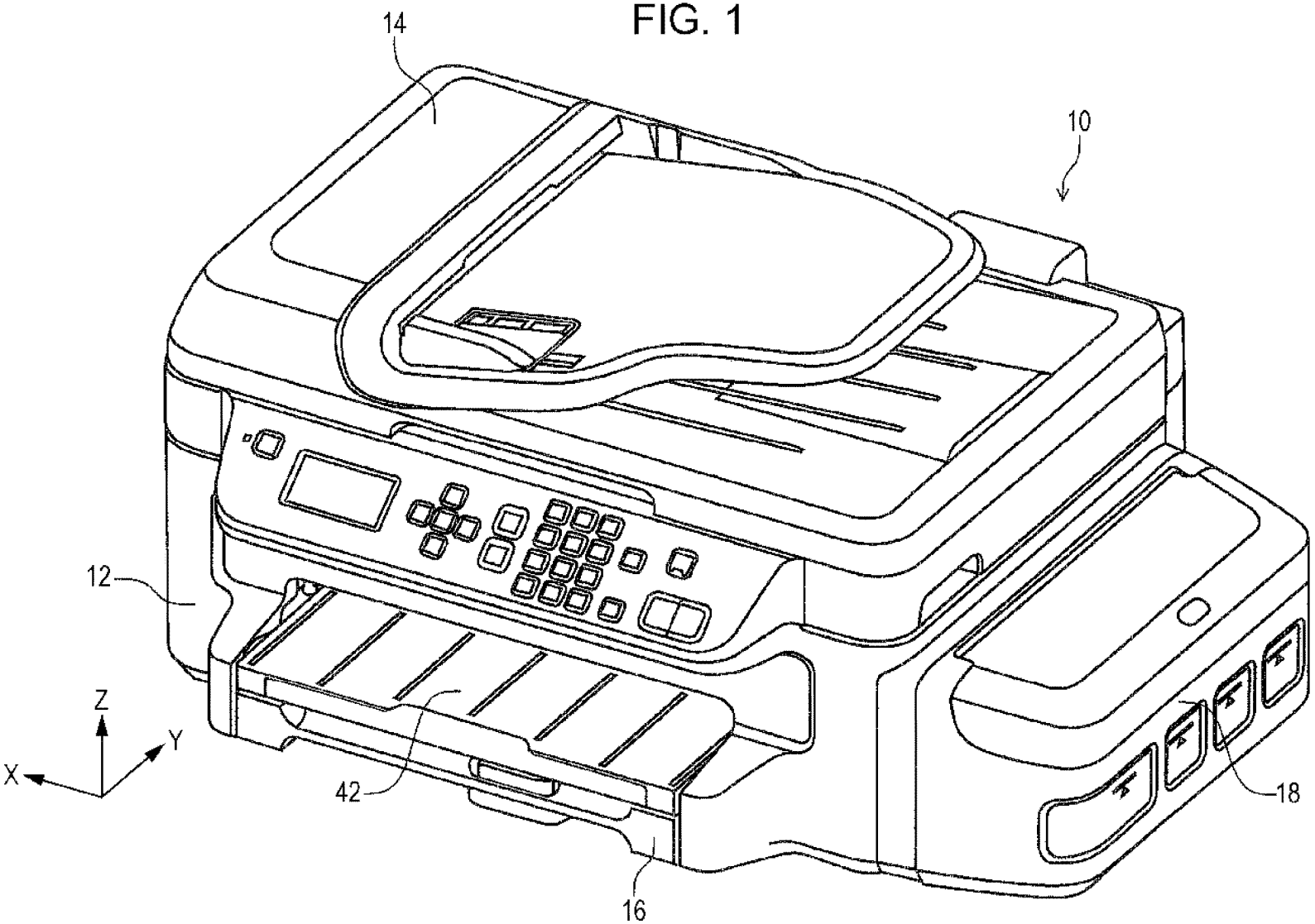
FIG. 1 is an external perspective view of a printer.

Hereinafter, embodiments of the invention will be described on the basis of the drawings. Additionally, in each example, like reference numerals will be given to like configurations, description will only be given in the initial example, and description thereof will be omitted in subsequent examples.

First Example

Figure 2:
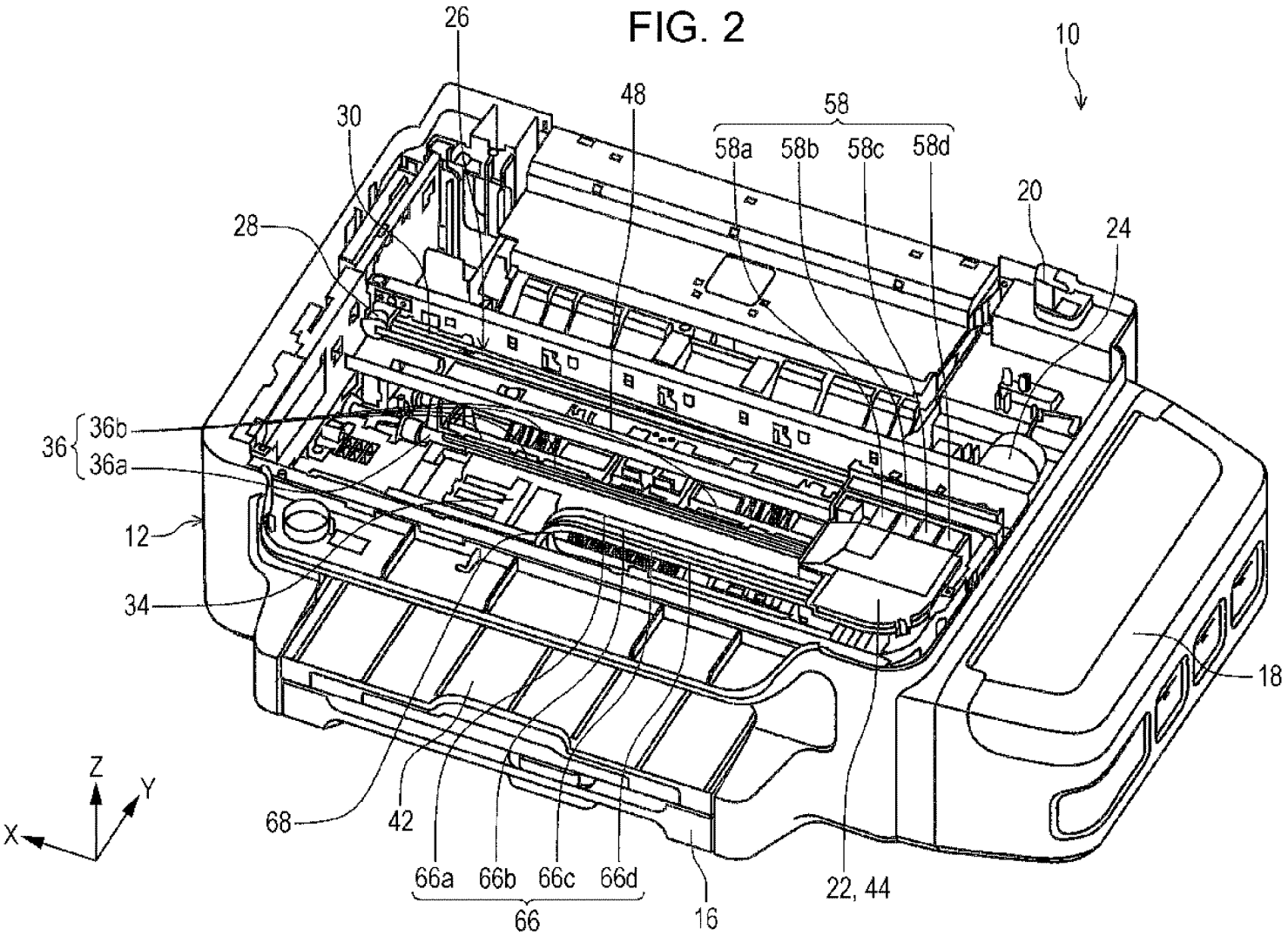
FIG. 2 is a perspective view that shows an internal structure of the printer.
Figure 3:
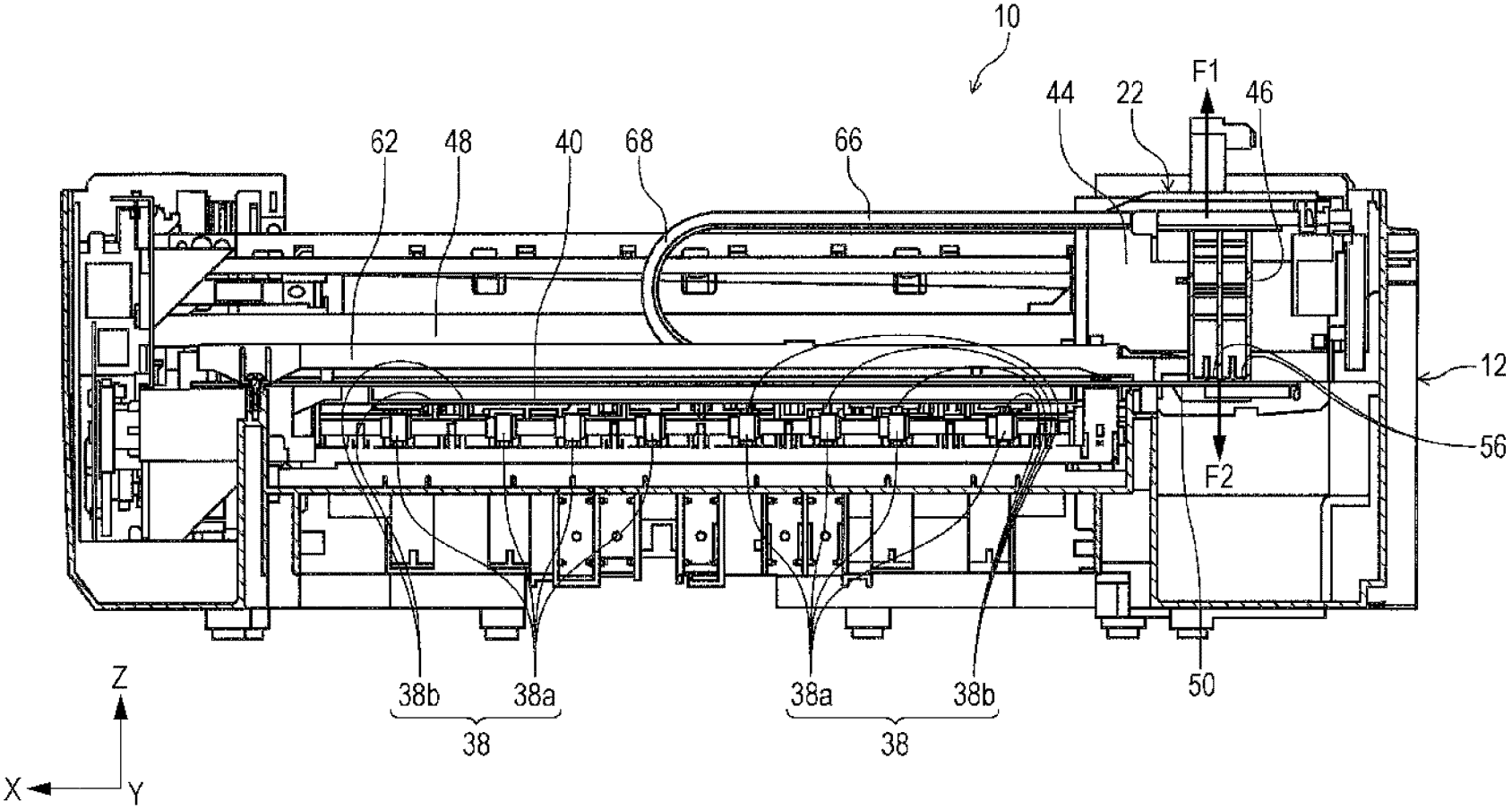
FIG. 3 is a partial cross-sectional view that shows the internal structure of the printer.
Figure 4:
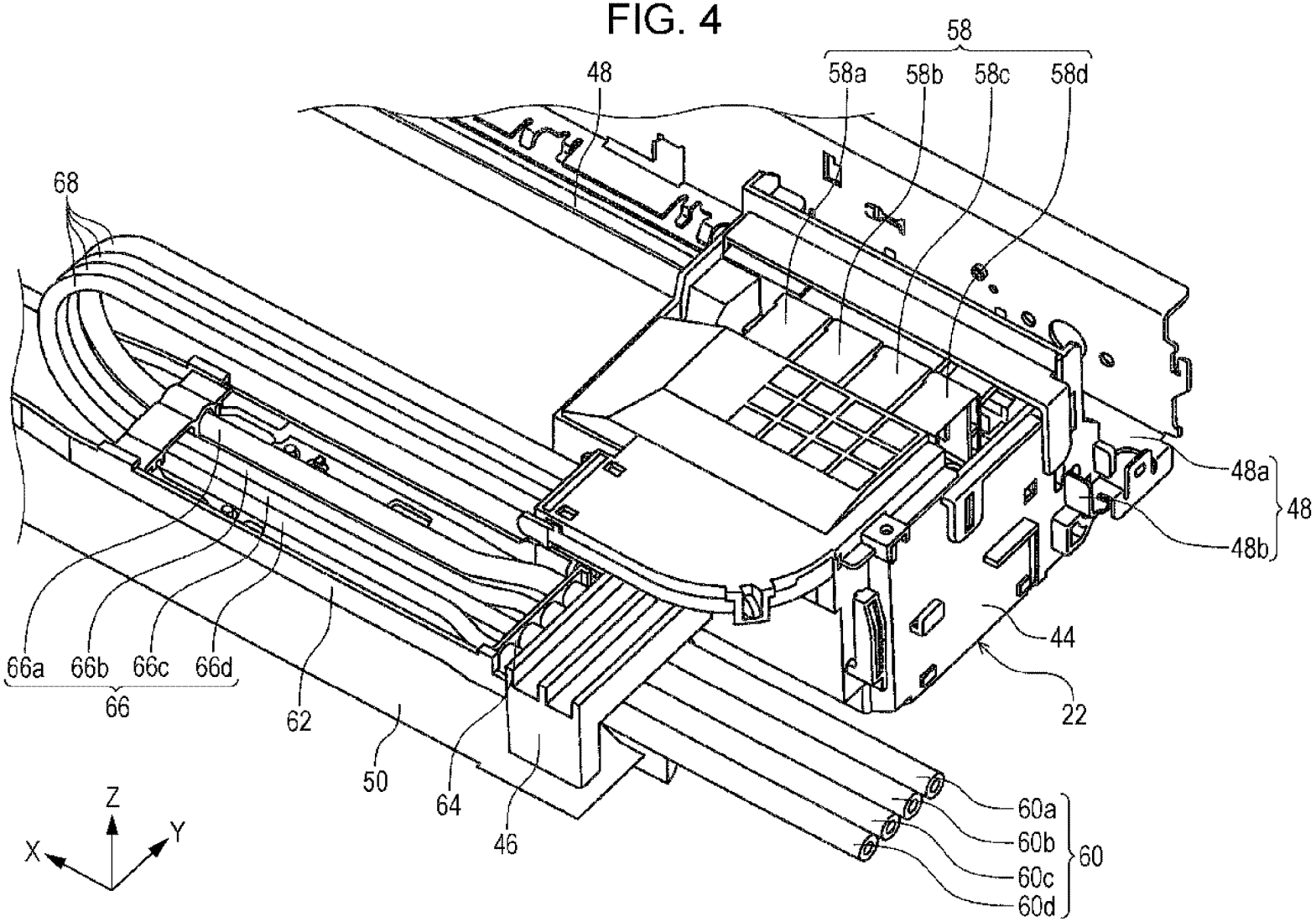
FIG. 4 is a perspective view of a carriage.
Figure 5:
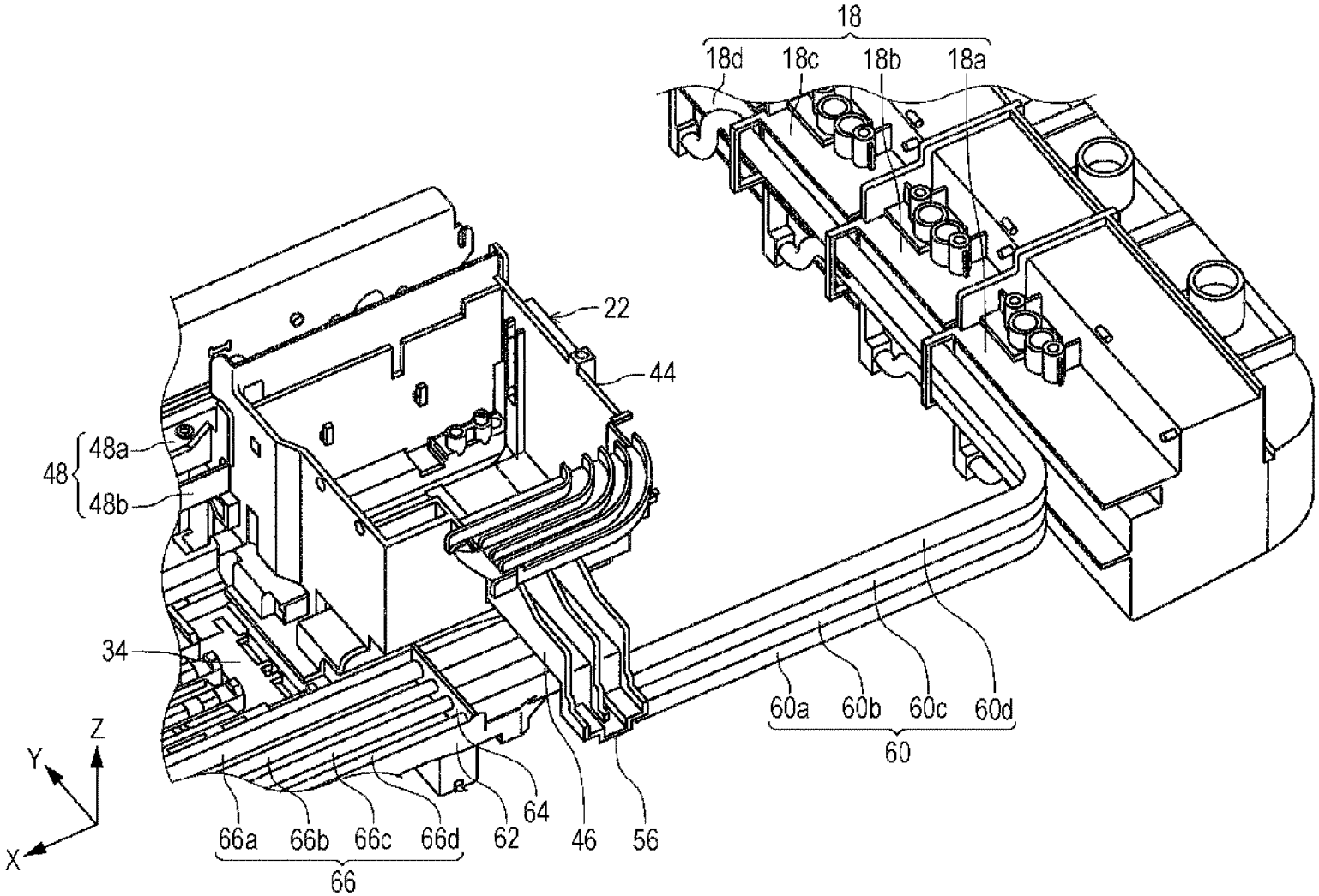
FIG. 5 is a perspective view that shows a pathway of an ink tube from an ink tank to a tube diameter conversion member.
Figure 6:
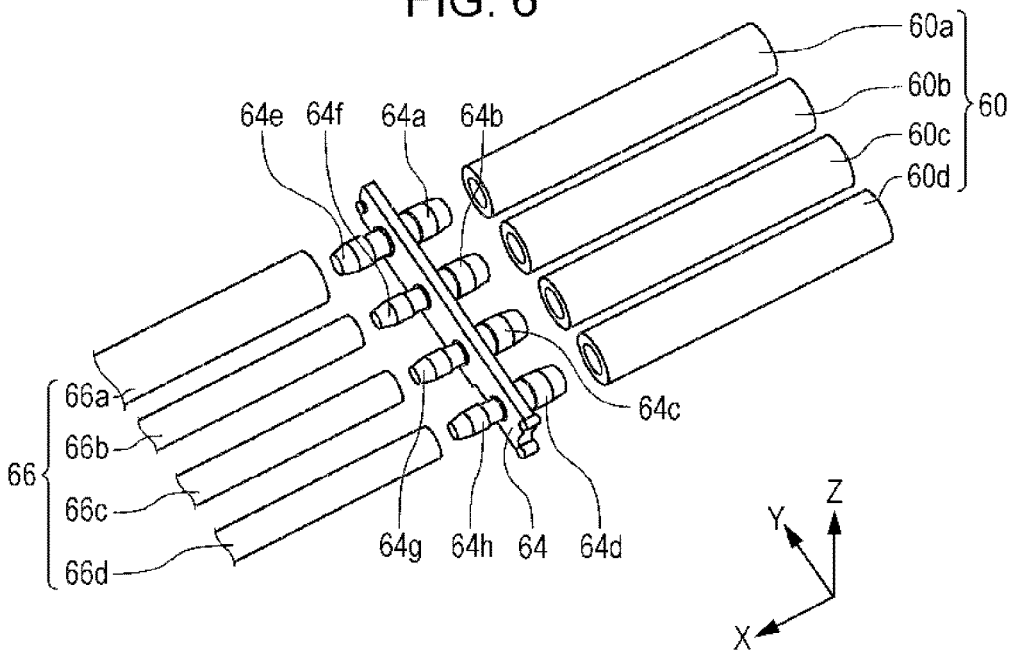
FIG. 6 is a perspective view that shows the tube diameter conversion member.
Figure 7:
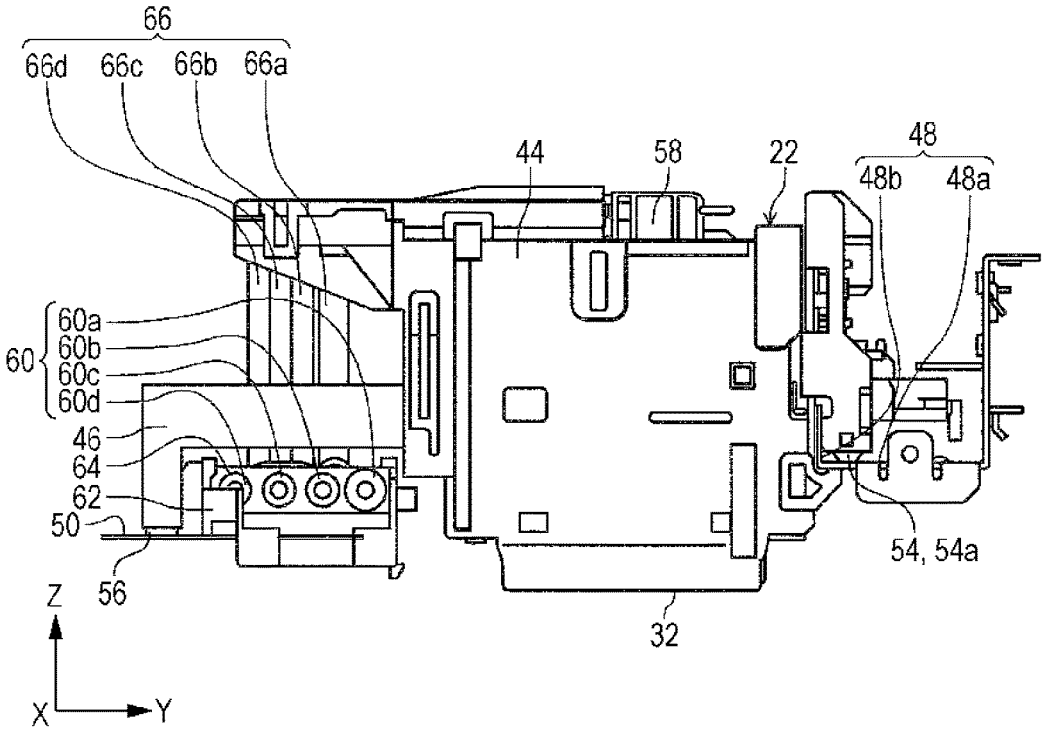
FIG. 7 is a side view of the carriage.

FIG. 1 is an external perspective view of a printer 10 according to a first example, FIG. 2 is a perspective view that shows an internal structure of the printer 10 according to the first example, FIG. 3 is a partial cross-sectional view that shows the internal structure of the printer 10 according to the first example, FIG. 4 is a perspective view of a carriage according to the first example, FIG. 5 is a perspective view that shows a pathway of an ink tube from an ink tank to a tube diameter conversion member, FIG. 6 is a perspective view that shows the tube diameter conversion member, and FIG. 7 is a side view of the carriage according to the first example.

Figure 8:
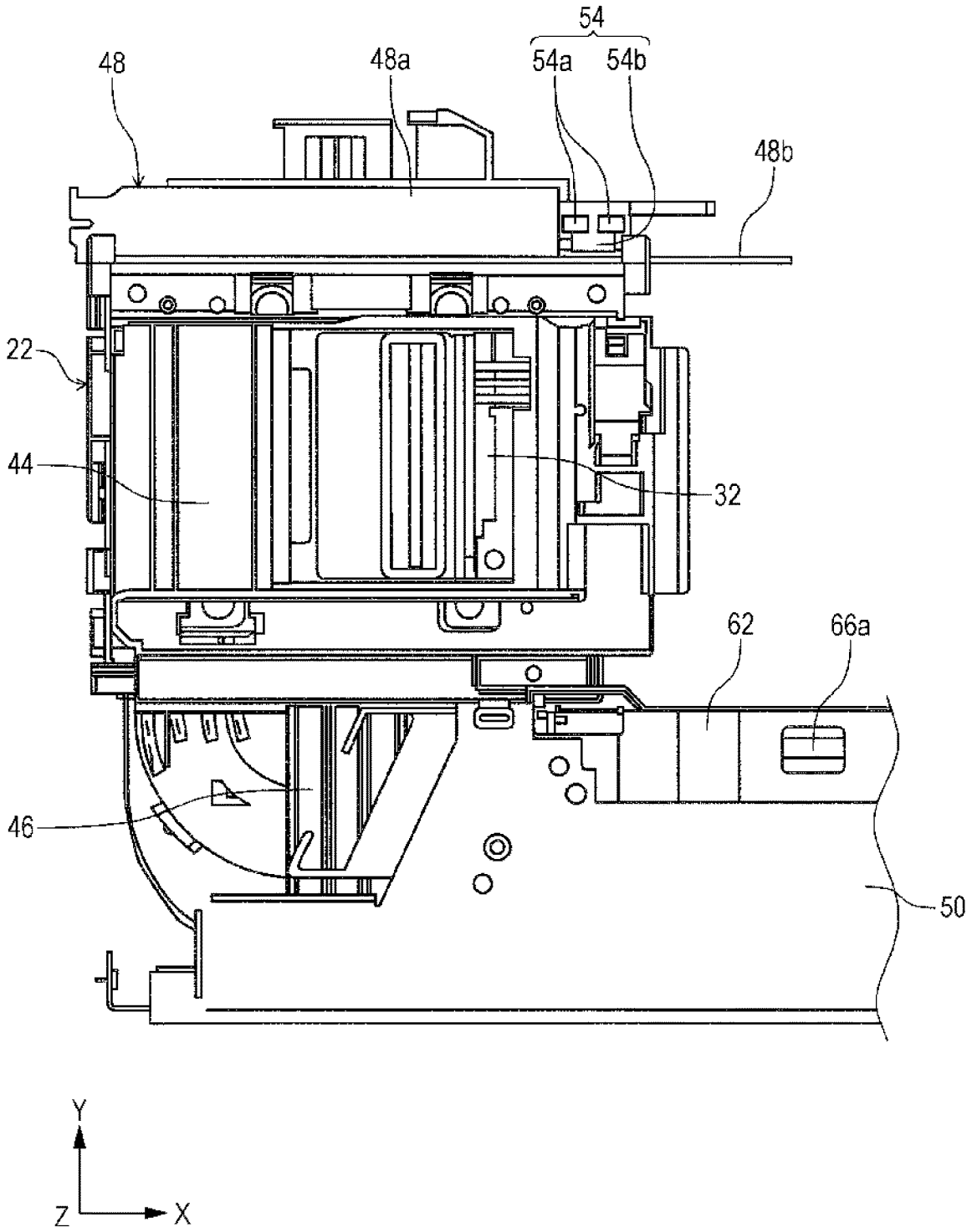
FIG. 8 is a bottom view of the carriage.
Figure 9A:
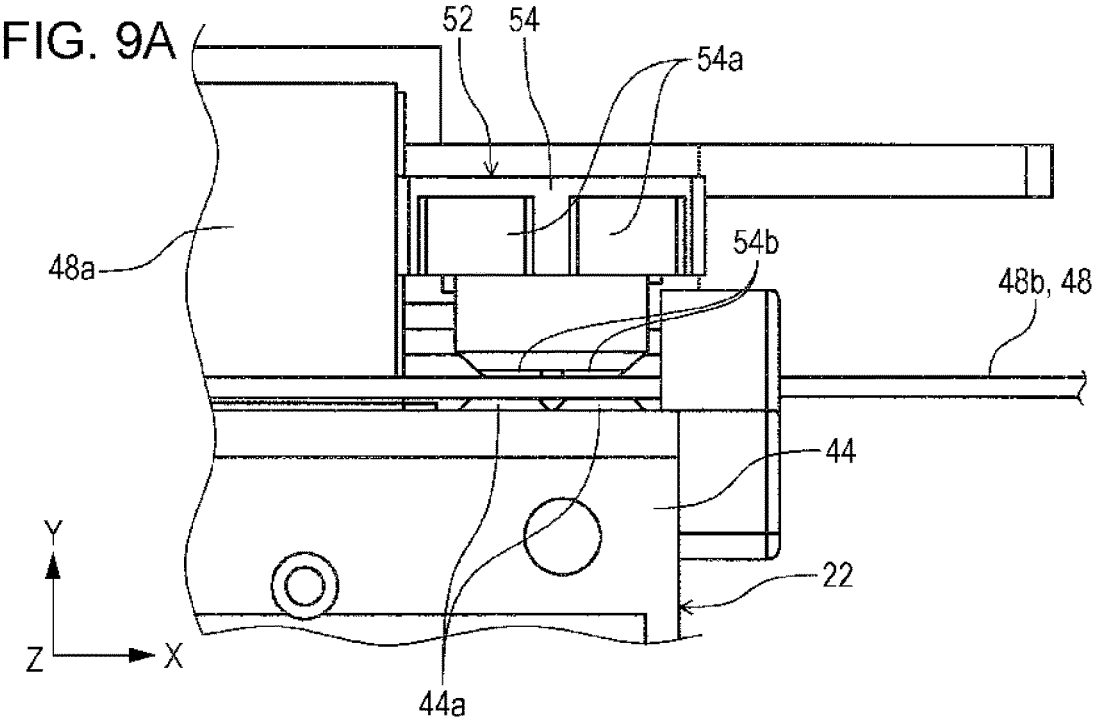
FIG. 9A is a bottom view that shows a first sliding section.
Figure 9B:
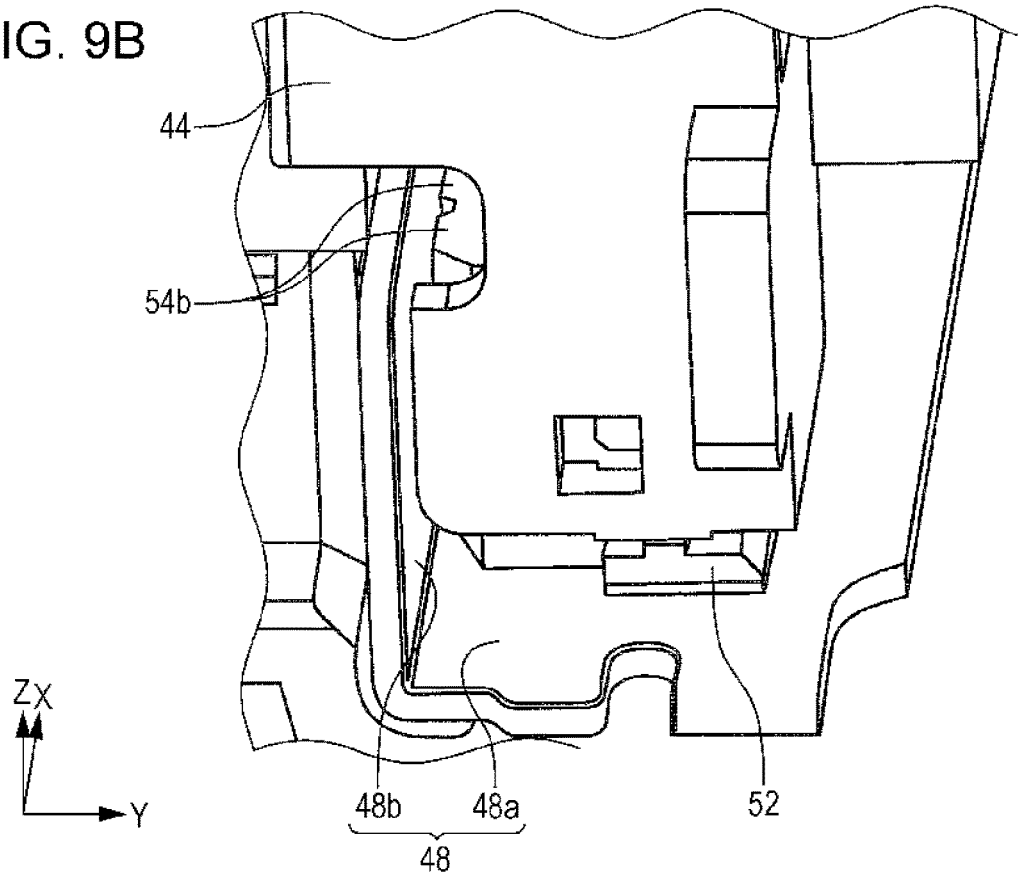
FIG. 9B is a perspective view that shows a first guide member and the first sliding section.
Figure 10:
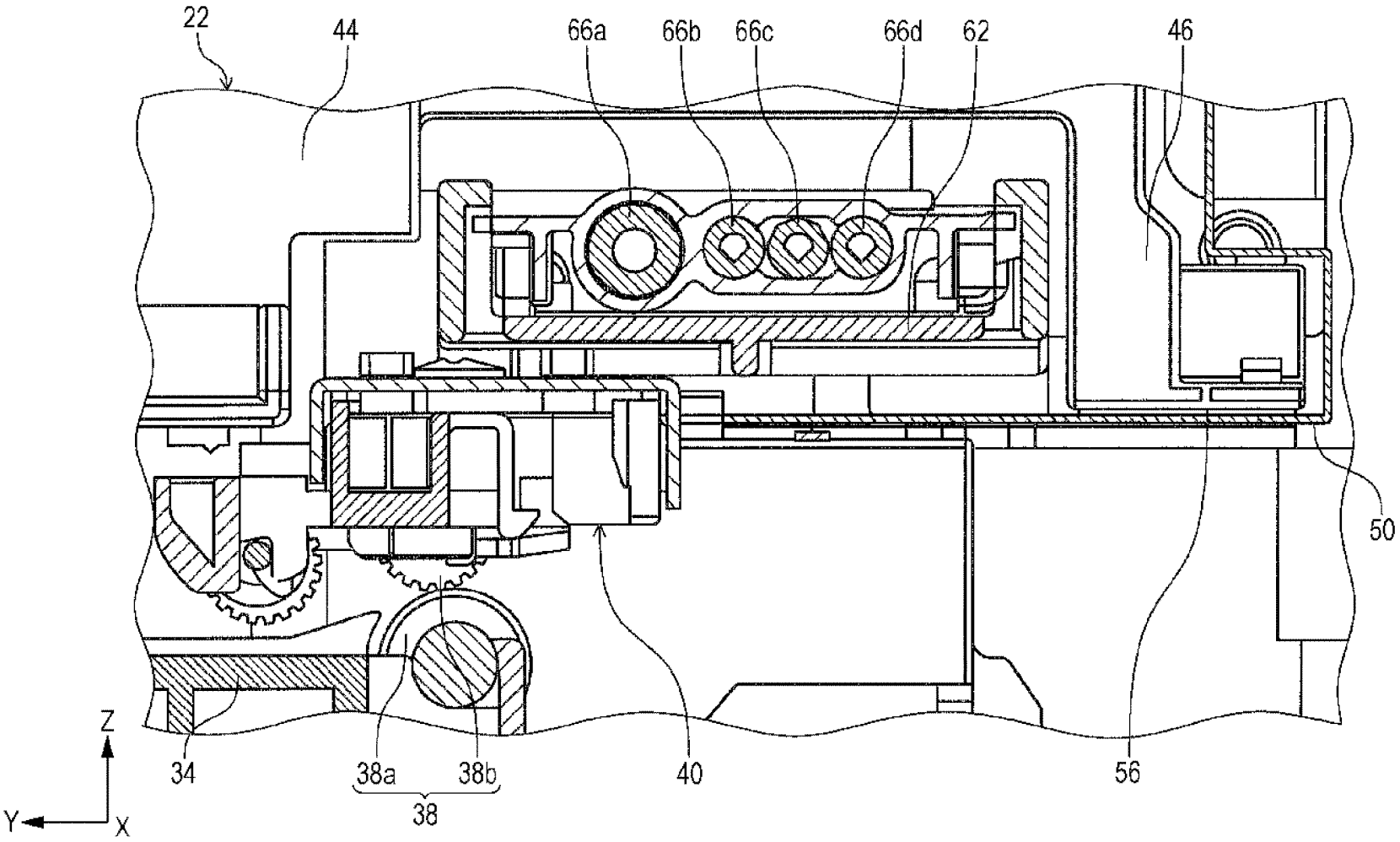
FIG. 10 is a cross-sectional view that shows a relationship between a tube guide member and a retaining member.
Figure 11:
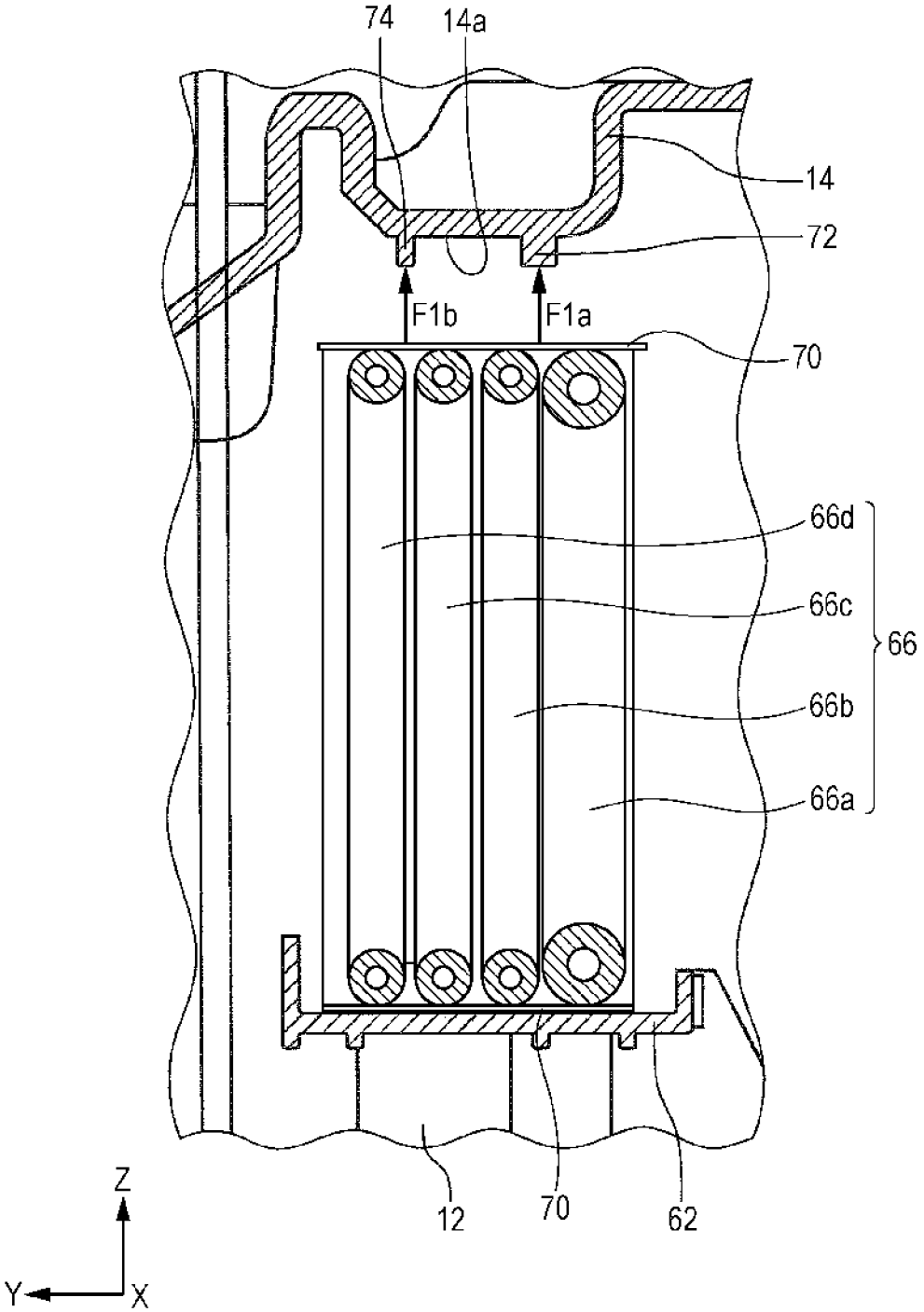
FIG. 11 is a lateral cross-sectional view that shows a relationship between an ink tube protection member and ribs, which are provided in a bottom section of an image reading device.
Figure 12:
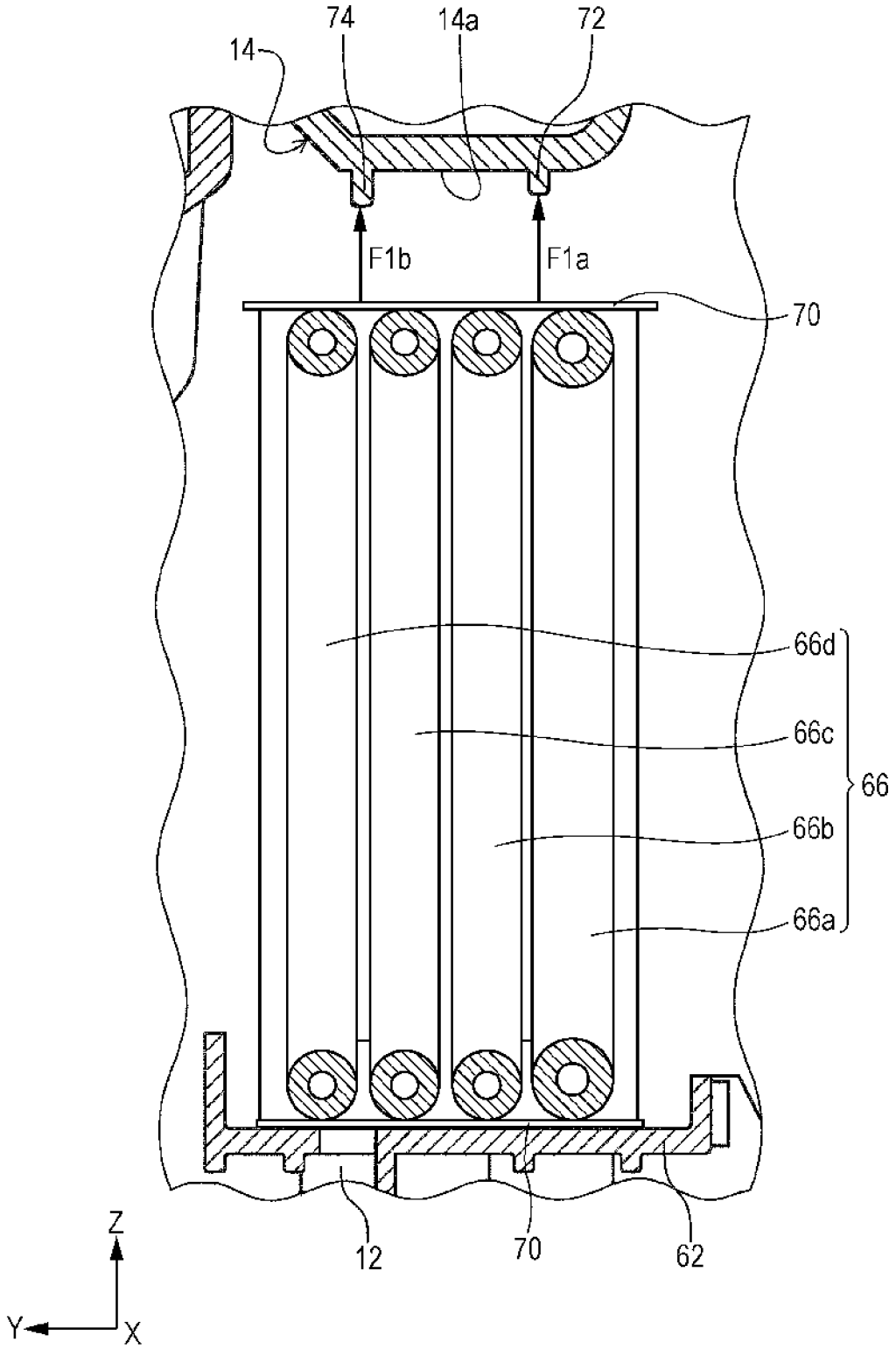
FIG. 12 is a lateral cross-sectional view that shows a relationship between the ink tube protection member and ribs according to a modification example of a first example, which are provided in the bottom section of the image reading device.
Figure 13:
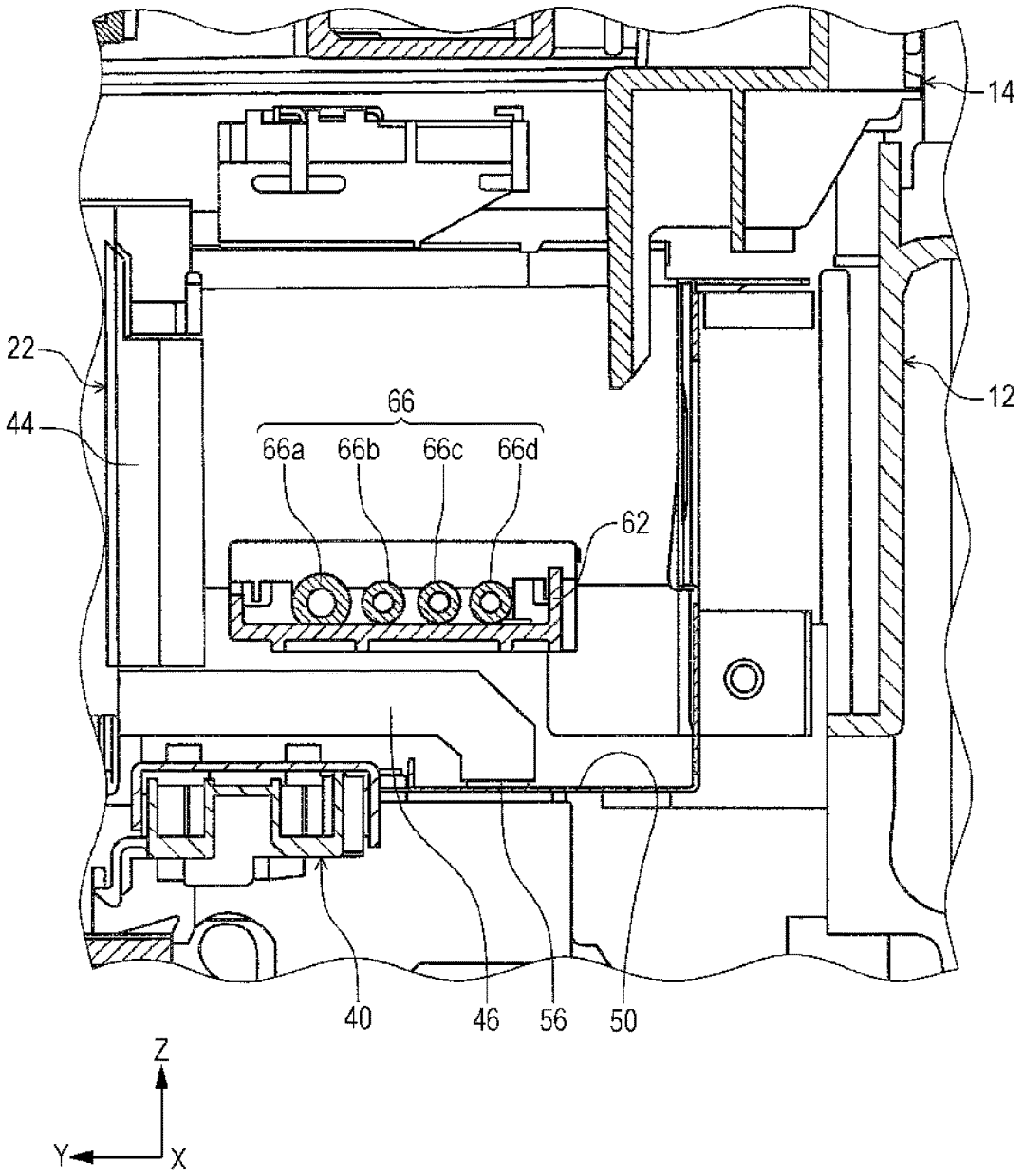
FIG. 13 is a cross-sectional view that shows a relationship between an arm section and a tube guide member according to the modification example of the first example.
Figure 14:
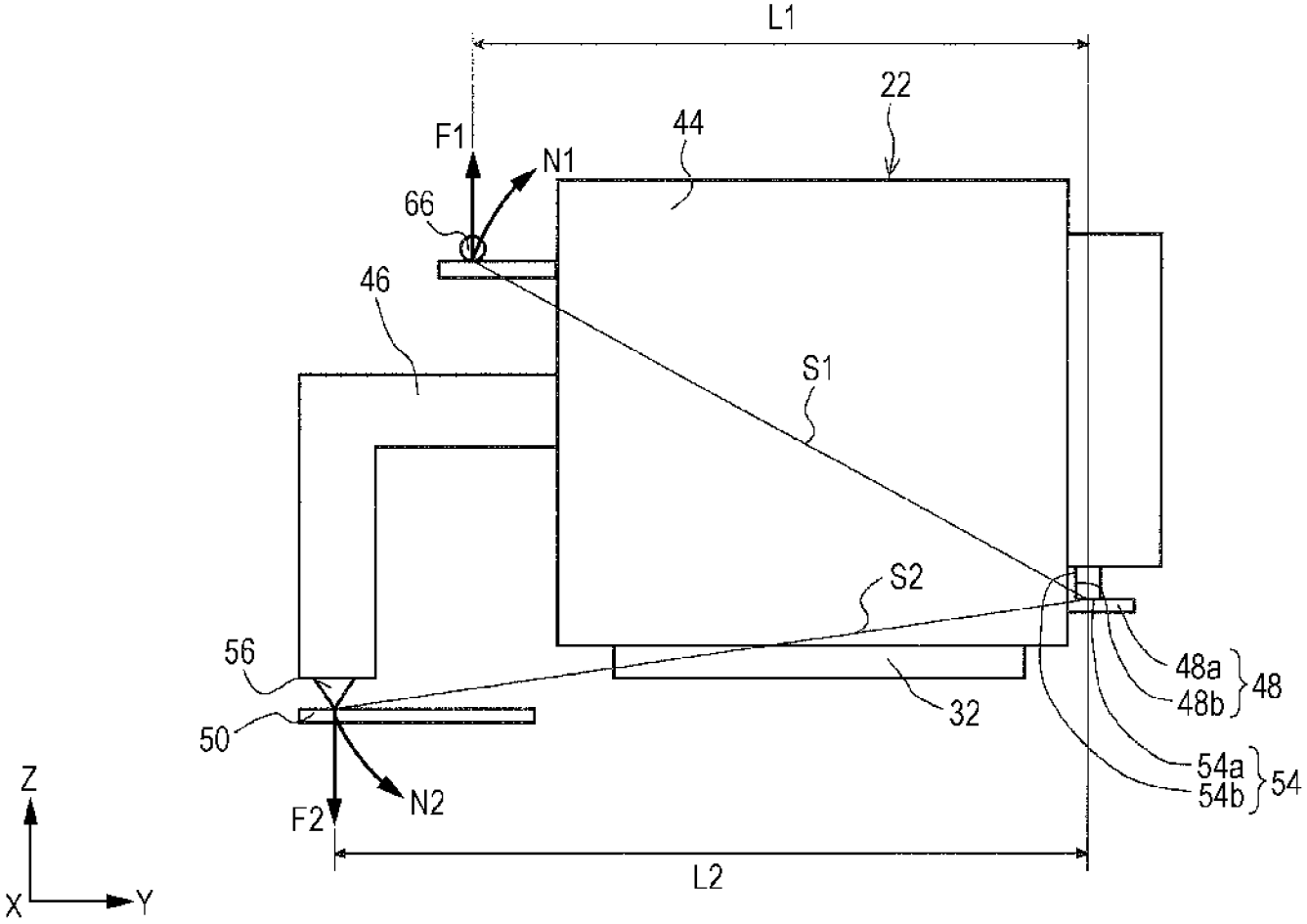
FIG. 14 is a schematic view that shows a relationship between a force and a moment in the carriage.

FIG. 8 is a bottom view of the carriage according to the first example, FIG. 9A is a bottom view that shows a first sliding section, FIG. 9B is a perspective view that shows a main guide rail and the first sliding section, FIG. 10 is a cross-sectional view that shows a relationship between a tube guide member and a retaining member, FIG. 11 is a lateral cross-sectional view that shows a relationship between an ink tube protection member and ribs, which are provided in a bottom section of an image reading device according to the first example, FIG. 12 is a lateral cross-sectional view that shows a relationship between the ink tube protection member and ribs according to a modification example of the first example, which are provided in the bottom section of the image reading device, FIG. 13 is a cross-sectional view that shows a relationship between an arm section and a tube guide member according to the modification example of the first example, and FIG. 14 is a schematic view that shows a relationship between a force and a moment in the carriage according to the first example.

In addition, in an X-Y-Z coordinate system that is shown in each drawing, an X direction (an apparatus width direction) as a "first direction" shows a scanning direction of a recording head, a Y direction as a "second direction" shows a depth direction of the recording apparatus, and a Z direction shows a "direction of change in a distance (a gap) between the recording head and sheets of paper, that is, an apparatus height direction. Additionally, in each drawing, a −Y direction is set as an apparatus anterior surface side and a +Y direction side is set as an apparatus back surface side.

Outline of Printer

An ink jet printer 10 (hereinafter, referred to as a "printer") will be described as an example of a recording apparatus with reference to FIGS. 1 and 2. The printer 10 is configured as a multifunction machine that is provided with an apparatus main body 12, and an image reading device 14. The apparatus main body 12 is provided with a target recording medium accommodation cassette 16, which accommodates a target recording medium, and an ink tank 18 as a "liquid accommodation section", which accommodates ink as a "liquid".

The image reading device 14 is attached to an upper section of the apparatus main body 12 through a hinge 20 (refer to FIG. 2), which is provided in an upper section of the apparatus main body 12. The image reading device 14 is configured to be capable of revolving with respect to the apparatus main body 12 with the hinge 20 as the pivot point thereof. Additionally, in the present example, the hinge 20 is provided on a back surface side of the apparatus main body 12, and the image reading device 14 revolves from a front surface side of the apparatus main body 12 toward the back surface side. In addition, as one example, the image reading device 14 in the present example is configured as a scanner unit as an example.

The target recording medium accommodation cassette 16 is configured so as to be capable of accommodating a plurality of sheets of the target recording medium, and is removably attached from an anterior surface side (a −Y axis direction side in FIG. 1) of the apparatus main body 12. Additionally, in the present specification, the term target recording medium indicates sheets of paper such as normal paper, heavy paper or photographic paper as an example.

In addition, a plurality of the ink tanks 18 are provided on a right surface side (a −X axis direction side in FIG. 1) of the apparatus main body 12 as large capacity ink tanks that accommodate the ink (refer to FIG. 5). In addition, the plurality of ink tanks 18*a*, 18*b*, 18*c* and 18*d* are provided to correspond to each color of black, cyan, magenta and yellow as an example.

Next, the configuration of the apparatus main body 12 will be described with reference to FIGS. 2 and 3. A carriage 22, which is capable freely moving in the apparatus width direction (an X axis direction in FIG. 2), is provided inside the apparatus main body 12. The carriage 22 is driven in the apparatus width direction by a carriage driving mechanism 26, which is driven by a driving motor 24 (refer to FIG. 2).

In the present example, the carriage driving mechanism 26 is provided with a driving pulley that is attached to the driving motor 24 (not illustrated in the drawings), a driven pulley 28 that is provided at an interval from the driving pulley in the apparatus width direction, and a toothed belt 30 that is hung around the driving pulley and the driven pulley. A part of the toothed belt 30 is gripped by the carriage 22.

Accordingly, when the driving pulley is driven to rotate by the driving motor 24, the toothed belt 30 is driven, and the carriage 22, which grips a part of the toothed belt 30, is moved in the apparatus width direction.

In addition, a recording head 32 is provided in a bottom section of the carriage 22 (refer to FIGS. 7 and 8). Furthermore, a medium support member 34, which extends in the apparatus width direction, is provided below the carriage 22. At least a part of the medium support member 34 is provided inside a movement region of the carriage 22 in the apparatus width direction, and the medium support member 34 faces the recording head 32 when the carriage 22 moves in the movement region of the carriage 22.

Additionally, the medium support member 34 supports a target recording medium that is transported from the target recording medium accommodation cassette 16. Further, the recording head 32 faces sheets of paper that are supported by the medium support member 34. In addition, the medium support member 34 stipulates a distance (a gap) between a recording surface of the target recording medium and a head surface of the recording head 32 by supporting the target recording medium from below. In addition, a plurality of nozzle holes (not illustrated in the drawings) are provided on a surface of the recording head 32 that faces the target recording medium, and recording on the target recording medium is executed by discharging the ink from the corresponding nozzle holes toward the recording surface of the target recording medium.

In addition, a pair of transport rollers 36 is provided on the apparatus back surface side (an upstream side in a transport pathway) of the carriage 22 in the apparatus depth direction. The pair of transport rollers 36 is provided with a transport driving roller 36*a* and a transport driven roller 36*b* (refer to FIG. 2).

In addition, a pair of ejection rollers 38 is provided on the apparatus front surface side (a downstream side in the transport pathway) of the carriage 22 in the apparatus depth direction. The pair of ejection rollers 38 is provided with an ejection driving roller 38*a* and an ejection driven roller 38*b* (refer to FIGS. 3 and 10). In the present example, the ejection driven roller 38*b* is configured as a spur, and is retained in a rotatable manner by a retaining member 40 that is attached to the apparatus main body 12.

In addition, an ejection stacker 42 is provided on the apparatus front surface side (the downstream side in the transport pathway) in the apparatus depth direction with respect to the pair of ejection rollers 38. It is possible to stack target recording media that is ejected by the pair of ejection rollers 38 on the ejection stacker 42.

In this instance, if the transport pathway of the target recording medium is described, a target recording medium that is accommodated in the target recording medium accommodation cassette 16 is transported from the target recording medium accommodation cassette 16 toward the pair of transport rollers 36, which are positioned on the downstream side in the transport pathway, by feeding means, which are not illustrated in the drawings. Further, the target recording medium is nipped by the transport driving roller 36*a* and the transport driven roller 36*b*, and transported toward the medium support member 34, which is positioned on the downstream side in the transport pathway. Subsequently, recording is executed on the target recording medium that is transported onto the medium support member 34 by the recording head 32. Further, the target recording medium on which recording has been executed is nipped by the ejection driving roller 38*a* and the ejection driven roller 38*b*, and ejected toward the ejection stacker 42.

Outline of Carriage

Next, an outline of the carriage 22 will be described with reference to FIGS. 2 to 10. As can be seen with reference to FIGS. 4, 5 and 7, the carriage 22 is provided with a box-shaped housing 44, an arm section 46 that protrudes from the housing 44 on the apparatus front surface side in the apparatus depth direction, and the recording head 32 that is provided in the bottom section of the housing 44 (refer to FIG. 8).

In addition, the carriage 22 is configured to be capable of reciprocating motion in the apparatus width direction inside the apparatus main body 12. More specifically, as shown in FIG. 4, a first guide member 48 that extends in the apparatus width direction, and a second guide member 50 that is disposed on the apparatus front surface side at a distance from the first guide member 48 in the apparatus depth direction, and extends in the apparatus width direction, are attached to the apparatus main body 12. In the present example, the first guide member 48 and the second guide member 50 are configured as guide rails.

In the present example, as shown in FIG. 9B, the first guide member 48 is provided with a flat section 48*a* and an inverted section 48*b* that extends from the flat section 48*a* in the apparatus height direction, and the flat section 48*a* and the inverted section 48*b* respectively extend in the apparatus width direction.

Gap adjustment means 52 (refer to FIG. 9B) are provided in the housing 44 on the apparatus back surface side, which is "one side" in the apparatus depth direction. Although not illustrated in the drawings, the gap adjustment means 52 is configured so as to be capable of adjusting a position of the carriage 22 in the apparatus height direction. In addition, a first sliding section 54 is provided in the gap adjustment means 52.

A flat sliding site 54*a* that slides in contact with the flat section 48*a* of the first guide member 48, and an inverted sliding site 54*b* that slides in contact with the inverted section 48*b*, are provided in the first sliding section 54 (refer to FIGS. 8 and 9A). The flat sliding site 54*a* is supported in the apparatus height direction by the flat section 48*a* of the first guide member 48.

In addition, a housing sliding section 44*a* is provided on an apparatus back surface side of the housing 44 in a position that faces the inverted sliding site 54*b* of the first sliding section 54 with the inverted section 48*b* of the first guide member 48 interposed therebetween. That is, the inverted section 48*b* of the first guide member 48 is in a state of being inserted between the inverted sliding site 54*b* of the first sliding section 54 and the housing sliding section 44*a*.

Accordingly, when the carriage 22 moves in the apparatus width direction, in addition to the carriage 22 being guided by the inverted section 48*b* of the first guide member 48, it is possible to regulate displacement of the carriage 22 in the apparatus depth direction. Accordingly, it is possible to suppress deteriorations in the recording quality on the target recording medium in the printer 10.

In addition, as shown in FIG. 5, the arm section 46 protrudes from the housing 44 on the apparatus front surface side, and extends downward at a tip end of a portion that protrudes, that is, toward the second guide member 50. Further, a second sliding section 56 is provided in the arm section 46 in a portion that comes into contact with the second guide member 50. In other words, the carriage 22 is supported by the second guide member 50 through the second sliding section 56.

Accordingly, the carriage 22 is supported by the first guide member 48 through the first sliding section 54 in the apparatus height direction, and is supported by the second guide member 50 in FIG. 7 through the second sliding section 56.

In addition, the second sliding section 56 is provided in the arm section 46. Therefore, a distance L2 (refer to FIG. 14) from the first sliding section 54 to the second sliding section 56 in the apparatus depth direction is longer than a distance from the first sliding section 54 to the second sliding section 56 in a case in which the second sliding section 56 is provided on the apparatus front surface side in the housing 44. As a result of this, in a case in which the height of the back surface side of the carriage 22 in the apparatus height direction is displaced by the gap adjustment means 52, an inclination angle of the recording head 32 with respect to the target recording medium that is supported on the medium support member 34, is small. Accordingly, it is possible to suppress deteriorations in the recording quality on the target recording medium.

Supply Pathway of Ink

Next, a supply pathway of ink will be described with reference to FIGS. 4 to 7. A plurality of connection adapters 58 are attached to the inside of the housing 44 of the carriage 22. Additionally, FIG. 5 shows the carriage 22 in a state in which the connection adapters 58 have been detached.

In the present example, connection adapters 58*a*, 58*b*, 58*c* and 58*d*, which correspond to each color of black, cyan, magenta, and yellow, are attached to the housing 44. The connection adapters 58*a*, 58*b*, 58*c* and 58*d* supply the ink of each color that is respectively supplied from the ink tanks 18*a*, 18*b*, 18*c* and 18*d*, to the recording head 32.

In addition, the ink tanks 18*a*, 18*b*, 18*c* and 18*d* are aligned along the apparatus depth direction. In the present example, the ink tank 18*a*, which accommodates black ink, is positioned furthest on the apparatus front surface side, and the ink tank 18*b*, which accommodates cyan, the ink tank 18*c*, which accommodates magenta, and the ink tank 18*d*, which accommodates yellow, are aligned in order toward the apparatus back surface side.

In addition, ink tubes 60*a*, 60*b*, 60*c* and 60*d* extend out from each ink tank 18*a*, 18*b*, 18*c* and 18*d* in the apparatus depth direction toward the apparatus front surface side. Each ink tube 60*a*, 60*b*, 60*c* and 60*d* extends changing from the apparatus depth direction in a region in which the ink tank 18*a* is provided in the apparatus depth direction toward a side that is opposite to a side on which the ink tanks 18 are provided in the apparatus width direction.

In addition, as can be seen with reference to FIGS. 3 to 5, a tube guide member 62 that extends in the apparatus width direction is provided in the apparatus main body 12 above the second guide member 50. A tube diameter conversion member 64 is attached to the tube guide member 62. The ink tubes 60*a*, 60*b*, 60*c* and 60*d*, the orientation of which changes to the apparatus width direction by extending out in the apparatus depth direction from each ink tank 18*a*, 18*b*, 18*c* and 18*d*, are connected to the tube diameter conversion member 64.

As shown in FIG. 6, the tube diameter conversion member 64 is provided with a plurality of connectors 64*a*, 64*b*, 64*c*, 64*d*, 64*e*, 64*f*, 64*g* and 64*h*. A plurality of connectors 64*a*, 64*b*, 64*c* and 64*d* are disposed on one of (the −X axis direction side in FIG. 6) the two sides of the tube diameter conversion member 64 aligned in the apparatus depth direction (the Y axis direction in FIG. 6). In addition, a plurality of connectors 64*e*, 64*f*, 64*g* and 64*h* are disposed on the other of (the +X axis direction side in FIG. 6) the two sides of the tube diameter conversion member 64 aligned in the apparatus depth direction (the Y axis direction in FIG. 6).

In addition, in the present example, the ink tubes 60*a*, 60*b*, 60*c* and 60*d* are respectively connected to the connectors 64*a*, 64*b*, 64*c* and 64*d*. Furthermore, the connectors 64*e*, 64*f*, 64*g* and 64*h* are provided in positions that respectively correspond to the connectors 64*a*, 64*b*, 64*c* and 64*d* in the apparatus depth direction.

In addition, ink tubes 66*a*, 66*b*, 66*c* and 66*d* are respectively connected to the connectors 64*e*, 64*f*, 64*g* and 64*h*. And the ink tubes 66*a*, 66*b*, 66*c* and 66*d* extend in the apparatus width direction from the tube diameter conversion member 64 to the other of (the +X axis direction side in FIG. 6) the two sides. In addition, the diameters of the ink tubes 66*b*, 66*c* and 66*d* are set to be more narrow that the diameters of the ink tubes 60*b*, 60*c* and 60*d*.

In this instance, the diameters of the connectors 64*b*, 64*c* and 64*d* are set to be larger than the diameters of the connectors 64*f*, 64*g* and 64*h*. In other words, the diameters of the ink tubes 60*b*, 60*c* and 60*d*, which are connected to the connectors 64*b*, 64*c* and 64*d*, are set to be larger than the diameters of the ink tubes 66*b*, 66*c* and 66*d*, which are connected to the connectors 64*f*, 64*g* and 64*h*. Accordingly, the diameter dimensions of the ink tubes that are connected on one side and the other side of the tube diameter conversion member 64, are converted.

Additionally, in the present example, the diameter of the ink tube 66*a*, which is connected to the connector 64*e*, is set to the same dimension as the diameter of the ink tube 60*a*, which is connected to the connector 64*a*. In other words, in the present example, the ink is supplied by the ink tubes 60*a* and 66*a*, which are the same diameter from the ink tank 18*a* to the connection adapter 58*a*, without performing conversion of the tube diameter between the connector 64*a* and the connector 64*e*.

In addition, as shown in FIGS. 4 and 7, the tube guide member 62 is provided between the first sliding section 54 and the second sliding section 56 in the apparatus depth direction, or more specifically, between an end section on the apparatus front surface side of the housing 44 of the carriage 22 and the second sliding section 56. In other words, the ink tubes 60, which extend out from the ink tanks 18, and the ink tubes 66, extend in the apparatus width direction passing below the arm section 46 between the first sliding section 54 and the second sliding section 56 in the apparatus depth direction.

Additionally, in the present example, a positional relationship of the first sliding section 54, the second sliding section 56 and the ink tubes 66 in the apparatus depth direction is set so that a distance L1 (refer to FIG. 14) between the first sliding section 54 and the ink tubes 66 in the apparatus depth direction is longer than a distance between the ink tubes 66 and the second sliding section 56.

In addition, the ink tubes 66*a*, 66*b*, 66*c* and 66*d*, which extend out from the tube diameter conversion member 64, extend in the apparatus width direction to a side that is opposite to a side on which the ink tanks 18 are provided, guided by the tube guide member 62, extend to the ink tank 18 side by curving and turning back, and are respectively connected to the connection adapters 58*a*, 58*b*, 58*c* and 58*d*, which are attached to the housing 44 of the carriage 22. In other words, the ink tubes 66 curve passing below the arm section 46, and are connected to the connection adapters 58 passing above the arm section by turning back in a vertical direction.

Accordingly, the ink, which is accommodated in the ink tanks 18, is supplied to the recording head 32 through the ink tubes 60, the tube diameter conversion member 64, the ink tubes 66 and the connection adapters 58.

Moment Force Acting on Carriage

In this instance, a force and a moment that act on the carriage 22 will be described with reference to FIG. 14. Additionally, FIG. 14 is a schematic view that shows a relationship between a force and a moment that act on the carriage 22. Additionally, in FIG. 14, only a single ink tube 66 is illustrated for purposes of description.

As shown in FIG. 14, the inverted section 48*b* of the first guide member 48 on the back surface side of the carriage 22 in the apparatus depth direction, is in a state of being inserted between the inverted sliding site 54*b* of the first sliding section 54 and the housing 44 of the carriage 22. Further, on a front surface side of the carriage 22 in the apparatus depth direction, since the second sliding section 56 is only supported from below by the second guide member 50, it is easy for the carriage 22 to rotate in a clockwise direction in FIG. 14 with the first sliding section 54 as a pivot point thereof.

In addition, a restoring force F1 that attempts to make a curve gentle, or on other words, attempts to restore the ink tube 66 to a state of being extended in a straight manner, occurs in the ink tube 66. Further, the restoring force F1 acts on the carriage 22, which the ink tube 66 is connected to, and, for example, attempts to separate the first sliding section 54 and the second sliding section 56 from the first guide member 48 or the second guide member 50 by lifting the carriage 22 up.

Since the restoring force F1 acts on the apparatus anterior surface side of the housing 44 of the carriage 22, a rotational moment force N1, which attempts to rotate the carriage 22 in the clockwise direction in FIG. 14 with the first sliding section 54 as the pivot point thereof, occurs in the carriage 22. In this instance, the rotational moment force N1 is the product of the length of a segment S1, which links the first sliding section 54 and the ink tube 66 with a straight line, and a component of the restoring force F1 that is orthogonal to the segment S1.

However, since the description thereof is complicated, in the present example, the product of the distance L1 from the first sliding section 54 to the ink tube 66 and the restoring force F1 is set as the rotational moment force N1. In the same manner, a rotational moment force N2 in the second sliding section 56, which will be described later, is also set as a moment force that is determined using the distance L2 in the apparatus depth direction instead of a distance of a segment S2 that links the first sliding section 54 and the second sliding section 56. Additionally, since it is possible to reduce the effect of the position of a center of gravity by taking a load (the restoring force F1 and a dead weight F2) into consideration, consideration of the position of the center of gravity is omitted.

Accordingly, the rotational moment force N1 has a relationship $N1=F1\times L1$. As a result of this, the rotational moment force N1 becomes proportionately larger with the distance L1 from the first sliding section 54 to the ink tube 66.

Meanwhile, among the dead weight of the carriage 22, the dead weight F2 of a fraction that acts on the arm section 46, acts on the second sliding section 56 that is provided in the arm section 46. More specifically, the dead weight F2 of the carriage 22 acts downward in the apparatus height direction, or in other words, toward the second guide member 50. That is, the second sliding section 56 applies a pressing force to the second guide member 50 using the dead weight F2 of the carriage 22. In this instance, since the dead weight F2 acts on a side of the second sliding section 56 that is opposite to a side on which the restoring force F1 acts, the rotational moment force N2 acts on the second sliding section 56 toward a direction that is opposite to that of the rotational moment force N1.

In this instance, the rotational moment force N2 is represented by the product of the dead weight F2 of the carriage 22 and the distance L2 from the first sliding section 54 to the second sliding section 56. In other words, the rotational moment force N2 has a relationship of $N2=F2\times L2$.

Additionally, in the present example, since the ink tube 66 extends in the apparatus width direction between the first sliding section 54 and the second sliding section 56 in the apparatus depth direction, the distance L1 from the first sliding section 54 to the ink tube 66 in the apparatus depth direction is shorter than the distance L2 from the first sliding section 54 to the second sliding section 56. In other words, the distance L2 from the first sliding section 54 to the second sliding section 56 is in a relationship of $L2>L1$ with respect to the distance L1 from the first sliding section 54 to the ink tube 66.

Accordingly, a relationship of rotational moment force N2>rotational moment force N1 is maintained in the carriage 22 by setting the dead weight F2 of the carriage 22 to a load that is greater than a value in which the rotational moment force N1 is divided by the distance L2.

As a result of this, since the rotational moment force N2 is greater than the rotational moment force N1, it is possible to suppress the separation of the second sliding section 56 from the second guide member 50.

In addition, in the present example, since the ink tube 66 extends in the apparatus width direction between the first sliding section 54 and the second sliding section 56 in the apparatus depth direction, it is possible to reduce the distance L1 between the ink tube 66 and the first sliding section 54 beyond that of a case in which the ink tube 66 is disposed on an outer side of the second sliding section 56 with respect to the first sliding section 54, or In other words, on the apparatus anterior surface side. As a result of this, the rotational moment force N1 in a case in which the ink tube 66 is positioned between the first sliding section 54 and the second sliding section 56 can be reduced beyond that of a case in which the ink tube 66 is disposed on an outer side of the second sliding section 56 with respect to the first sliding section 54.

As a result of this, it is possible to suppress the separation of the carriage 22 from the first guide member 48 or the second guide member 50. Accordingly, since the posture of the recording head 32, and furthermore, the carriage 22 is stabilized with respect to the target recording medium, it is possible to suppress deteriorations in the recording quality on the target recording medium.

In addition, as shown in FIGS. 3 and 4, in the present example, the second sliding section 56 is provided in the arm section 46 protruding from the housing 44 of the carriage 22 on the apparatus front surface side in the apparatus depth direction. As a result of this, it is possible to make the distance L2 between the first sliding section 54 to the second sliding section 56 in the apparatus depth direction longer. Accordingly, it is possible to increase the rotational moment force N2 due to the dead weight of the carriage 22, which acts on the second sliding section 56, and of which the first sliding section 54 is a pivot point. As a result of this, it is possible to suppress the separation of the carriage 22 from the first guide member 48 or the second guide member 50. Accordingly, since the posture of the recording head 32, and furthermore, the carriage 22 is stabilized with respect to the target recording medium, it is possible to suppress deteriorations in the recording quality on the target recording medium.

In addition, since inclination of the carriage 22 with the apparatus width direction as a rotational axis thereof is reduced if the distance of the arm section 46 in the apparatus depth direction is increased, it is possible to maintain the recording quality on the target recording medium in the recording head 32.

In addition, in the present example, since the ink tubes 66 are connected to the connection adapters 58, which are attached to the carriage 22, above the arm section 46, by curving and turning back passing below the arm section 46, it is possible to make a curvature radius of a turnback portion 68 of the ink tube 66 greater. As a result of this, it is possible to reduce the restoring force F1 that attempts to make the curve, which occurs in the ink tube 66, gentle. As a result of this, it is possible to more reliably suppress a circumstance in which the restoring force F1 resists the dead weight F2 of the carriage 22 and attempts to separate the carriage 22 from the first guide member 48 or the second guide member 50. Therefore, it is possible to suppress deteriorations in the recording quality on the target recording medium as a result.

In addition, as shown in FIG. 14, the distance L1 from the first sliding section 54 to the ink tubes 66 in the apparatus depth direction is shorter than the distance L2 from the first sliding section 54 to the second sliding section 56. Accordingly, it is possible to reduce the rotational moment force N1, which occurs in the carriage 22, beyond the rotational moment force N2 due to the dead weight F2 of the carriage 22, which acts on the second sliding section 56. As a result of this, it is possible to suppress a circumstance in which the carriage 22 attempts to become separated from the second guide member 50. Therefore, it is possible to suppress deteriorations in the recording quality on the target recording medium as a result.

In addition, as can be seen with reference to FIGS. 3 and 4, the turnback portion 68, which curves in the pathway from the tube diameter conversion member 64 of the ink tube 66 to the connection adapters 58 of the carriage 22, moves while deforming in the apparatus width direction following movement of the carriage 22 in the apparatus width direction. Additionally, in the present example, the tube diameter conversion member 64 is provided in a position that is shifted from the movement region of the turnback portion 68 in the apparatus width direction.

That is, in the present example, the tube diameter of the ink tubes 60 from the ink tanks 18 to the tube diameter conversion member 64 is wider than the tube diameter of the ink tubes 66 from the tube diameter conversion member 64 to the carriage 22 through the turnback portion 68. In other words, the diameter of the tube from the ink tanks 18 to the tube diameter conversion member 64 is wide, the diameter of the tube from the tube diameter conversion member 64 to the carriage 22 is narrow. Therefore, in comparison with a case in which the tube diameters of the ink tubes 60 and 66 are narrow throughout the entire pathway from the ink tanks 18 to the carriage 22, it is possible to reduce pressure loss by making the tube diameter of the ink tubes 60 in the pathway from the ink tanks 18 to the tube diameter conversion member 64 wide, and therefore, it is possible to suppress nozzle slip-out in the recording head 32.

In addition, since the diameter of the tube of the ink tubes 66 from the tube diameter conversion member 64 to the carriage 22 is narrow, that is, the tube diameter of a portion that corresponds to operation of the carriage 22 is narrow, it is possible to reduce a reaction force of the ink tubes 66 that is transmitted to the carriage 22, and therefore, it is possible to maintain the recording quality on the target recording medium in the recording head 32.

In addition, in the present example, the ink tubes 66*a*, 66*b*, 66*c* and 66*d* are disposed aligned above the tube guide member 62 in the apparatus depth direction. In this instance, the ink tube 66*a*, which has the widest diameter, is disposed on the back surface side in the apparatus depth direction, that is, close to the first sliding section 54. In this instance, the ink tube 66*a* is connected to the ink tube 60*a* through the tube diameter conversion member 64. Further, the ink tube 60*a* is connected to the ink tank 18*a*, which accommodates the black ink. Accordingly, in the present example, the black ink is fed using the ink tubes 60*a* and 66*a*, which have wide tube diameters, in the pathway from the ink tank 18*a* to the carriage 22.

As shown in FIG. 7, in the present example, among the ink tubes 66*a*, 66*b*, 66*c* and 66*d*, which are arranged in a plurality in the apparatus depth direction, the ink tube 66*a*, which is arranged closest to the first sliding section 54, is wider than the other ink tubes 66*b*, 66*c* and 66*d*. In this instance, the restoring force F1 that attempts to make the curve, which occurs in the turnback portion 68 of the ink tubes 66, gentle becomes larger as the diameters of the ink tubes 66 become wider. Accordingly, in the present example, the ink tube 66*a*, which has the largest restoring force F1, is disposed close to the first sliding section 54, but since it is possible to make the distance L1 between the ink tube 66*a*, which has the largest restoring force F1, and the first sliding section 54 smaller, it is possible to reduce the moment force N1 that attempts to rotate the carriage 22 with the first sliding section 54 as the pivot point thereof. Accordingly, it is possible to suppress a circumstance in which the carriage 22 attempts to become separated from the second guide member 50. Therefore, it is possible to suppress deteriorations in the recording quality on the target recording medium as a result.

In addition, in the present example, the ink tube 66*a*, which has the widest diameter, supplies the black ink to the recording head 32. In this instance, in the printer 10, ink of a plurality of colors, for example, black, cyan, magenta, yellow, and the like, is used, but the usage amount of black ink is the highest. In the present example, it is possible to supply the black ink from the ink tank 18*a* to the recording head 32 in the ink tube 66*a*, which has the widest diameter among the plurality of ink tubes 66*a*, 66*b*, 66*c* and 66*d*. In other words, since it is possible to increase the supply amount to the recording head 32 of black ink, for which the usage amount is highest, it is possible to stabilize the supply of black ink to the recording head 32.

In addition, as shown in FIGS. 5 and 7, among the ink tanks 18*a*, 18*b*, 18*c* and 18*d*, at least a part of the ink tank 18*a*, which is positioned closest to the second sliding section 56 along the apparatus depth direction, and at least a part of the ink tube 66*a*, which has the widest tube diameter, are in the same position in the apparatus depth direction. Further, the ink tank 18*a*, which is disposed closest to the second sliding section 56 is connected to the ink tube 66*a*, which has the widest tube diameter, through the ink tube 60*a* and the tube diameter conversion member 64.

In other words, the distance in the apparatus depth direction between the ink tank 18*a*, which is positioned closest to the second sliding section 56, and the ink tube 66*a*, which has the widest tube diameter, can be said to be shorter than the distances between the other ink tanks 18*b*, 18*c* and 18*d*, and the other ink tubes 66*b*, 66*c* and 66*d*. Accordingly, in the ink tubes 60*a*, 60*b*, 60*c* and 60*d*, which are connected to the tube diameter conversion member 64 by changing toward the apparatus width direction after extending out in the apparatus depth direction from each ink tank 18*a*, 18*b*, 18*c* and 18*d*, it is possible to make the pathway length of the ink tube 60*a* the shortest.

As a result of this, it is possible to make the pathway length in the ink tubes 60*a* and 66*a*, which have the widest tube diameters, from the ink tank 18*a*, which is positioned closest to the second sliding section 56, to the carriage 22 shorter than the pathway lengths in the other ink tubes 60*b*, 60*c*, 60*d*, 66*b*, 66*c* and 66*d* from the ink tanks 18*b*, 18*c* and 18*d* to the carriage 22.

In addition, as can be seen with reference to FIGS. 3 and 10, the tube guide member 62 is provided in a state of being separated from the retaining member 40, which retains the ejection driven roller 38*b* in a manner in which the ejection driven roller 38*b* is capable of rotating, in the apparatus height direction.

In the present example, since the tube guide member 62 and the retaining member 40 are separated, the retaining member 40 is not subjected to the restoring force F1, which attempts to make the curve that occurs in the ink tubes 66 gentle, via the tube guide member 62, and therefore, it is possible to suppress a circumstance in which the retaining member 40 becomes warped as a result of being subjected to the restoring force F1. As a result of this, since it is possible to suppress a circumstance in which the retaining member 40 becomes warped, it is possible to suppress deteriorations in an ejection property of the target recording medium since it is difficult for positional shift of the ejection driven roller 38*b* due to warping of the retaining member 40 to occur.

In addition, in the present example, since the second sliding section 56 is provided in the arm section 46, which extends in from the carriage 22 in the apparatus depth direction, it is possible to make the distance L2 between the first sliding section 54 to the second sliding section 56 in the apparatus depth direction longer without increasing the size of the carriage 22. As a result of this, an increase in the size of the carriage 22 is suppressed, and therefore, it is possible to reduce the size of the carriage 22 and it is possible to achieve a reduction in cost.

Ink Tube Protection Member

In addition, as can be seen with reference to FIG. 11, an ink tube protection member 70 is provided on the ink tubes 66 between the ink tubes 66 and the tube guide member 62, on an outer peripheral side of the curve of the turnback portion 68, between the ink tubes 66 and a bottom section 14*a* of the image reading device 14. The ink tube protection member 70 is a film form flexible member, and is attached so as to be positioned on the outer peripheral side of the curve of the turnback portion 68 along the pathway of the ink tubes 66. In the present example, the ink tube protection member is formed from a PET (polyethylene terephthalate) resin as an example.

In addition, a plurality of ribs 72 and 74 are provided on the bottom section 14*a* of the image reading device 14 in positions that correspond to the positions of the ink tubes 66 in the apparatus depth direction. In the present example, the rib 72 is provided in a position that corresponds to the ink tube 66*a*, which has the widest tube diameter, in the apparatus depth direction. In addition, the rib 74 is provided between the ink tube 66*b* and the ink tube 66*d* in the apparatus depth direction.

In the present example, the width of the rib 72 in the apparatus depth direction is set to be greater than the width of the rib 74. Further, the ribs 72 and 74 are subjected to the restoring force F1 from the ink tubes 66, which are subjected to the restoring force F1 through the ink tube protection member 70. In this instance, since the ink tube 66*a*, which has the widest tube diameter, is positioned on a side on which the rib 72 is provided, a restoring force F1a from the ink tubes 66, which the rib 72 is subjected to, is greater than a restoring force F1b from the ink tubes 66, which the rib 74 is subjected to.

However, in the present example, since the width of the rib 72 is greater than the width of the rib 74, it is possible to lower a contact pressure of the rib 72 with the ink tube protection member 70. Additionally, in the present example, a wear resistance of the ink tube protection member 70 is set to be lower than those of the ribs 72 and 74. As a result of this, it is possible to suppress uneven wear of the ink tube protection member 70, which occurs as a result of the differences in the restoring forces F1 of the ink tubes 66 in the apparatus depth direction.

Modification Examples of First Example (1) In the present example, the wear resistance of the ink tube protection member 70 is set to be smaller than those of the ribs 72 and 74, but in place of this configuration, the wear resistance of the ink tube protection member 70 may be set to be larger than those of the ribs 72 and 74. If set in this manner, it is possible to suppress uneven wear of the ribs 72 and 74.

(2) In addition, in the present example, a configuration in which the width of the rib 72 in the apparatus depth direction is greater than the width of the rib 74, is used, but in place of this configuration, as shown in FIG. 12, a protrusion amount of the rib 72 from the bottom section 14*a* of the image reading device 14 in the apparatus height direction may be set to be greater than a protrusion amount of the rib 74 from the bottom section 14*a* of the image reading device 14. By setting in this manner, since the curvature radius of the ink tube 66*a* on a rib 72 side is greater than those of the other ink tubes 66*b*, 66*c* and 66*d*, it is possible to reduce the restoring force F1a, which occurs in the ink tube 66*a*, beyond the restoring forces F1b, which occur in the other ink tubes 66*b*, 66*c* and 66*d*. As a result of this, it is possible to lower the contact pressure of the rib 72 with the ink tube protection member 70. Accordingly, it is possible to suppress uneven wear of the ink tube protection member 70, which occurs as a result of the differences in the restoring forces F1 of the ink tubes 66 in the apparatus depth direction.

(3) In the present example, a configuration in which the ink tubes 66 and the tube guide member 62 pass below the arm section 46, is used, but in place of this configuration, as shown in FIG. 13, the ink tubes 66 and the tube guide member 62 may be disposed so as to pass above the arm section 46.

(4) In addition, in the present example, a configuration in which the arm section 46, which protrudes from the carriage 22 is provided, and the ink tubes 66 pass below the arm section 46, is used, but in place of this configuration, a configuration in which the second sliding section 56 is provided in a lower section of the housing 44 of the carriage 22 on the apparatus front surface side, and the ink tubes 66 pass between the first sliding section 54 and the second sliding section 56 in the lower section of the housing 44, may be used.

(5) In addition, in the present example, the tube diameter of the ink tubes 60 and 66 is converted by the tube diameter conversion member 64, but in place of this configuration, the rigidity of the ink tubes 60 and 66 may be changed.

(6) In the present example, a configuration in which the flat sliding site 54*a* and the inverted sliding site 54*b* of the first sliding section 54 slide on the first guide member 48, which includes the flat section 48*a* and the inverted section 48*b*, is used, but in place of this configuration, the first guide member 48 may be an axial member.

If the abovementioned description is summarized, the printer 10 in the present example is provided with the recording head 32 that performs recording by discharging the ink onto the target recording medium, the carriage 22, on which the recording head 32 is provided, and which is capable of moving along the apparatus width direction, the first sliding section 54 that is provided in the carriage 22, on one side in the apparatus depth direction, the second sliding section 56 that is provided in the carriage 22, in the arm section 46, which extends from the other two side in the apparatus depth direction, protruding in the apparatus depth direction, the first guide member 48 that supports the carriage 22 by coming into contact with the first sliding section 54, and guides movement of the carriage 22, the second guide member 50 that extends in the apparatus width direction, is disposed at an interval from the first guide member 48 in the apparatus depth direction, supports the carriage 22 by coming into contact with the second sliding section 56, and guides the movement of the carriage 22, the ink tanks 18 that accommodate the ink, and the ink tubes 60 and 66, which are ink tubes 60 and 66 that supply the ink, which is delivered from the ink tanks 18, to the carriage 22, extend in a direction that intersects the apparatus depth direction by extending out from the carriage 22, and extend in an opposite direction by turning back in a vertical direction. The ink tubes 60 and 66 extend in the direction that intersects the apparatus depth direction by passing at least one of above and below the arm section 46.

The inverted sliding site 54*b* of the first sliding section 54 retains the carriage 22 in the apparatus depth direction by the inverted section 48*b* of the first guide member 48 being inserted between the housing sliding section 44*a* of the carriage 22 and inverted sliding site 54*b* of the first sliding section 54 in the apparatus depth direction, and the second sliding section 56 is supported from below by the second guide member 50. The ink tubes 66 are disposed in positions at which the distance L1 from the first sliding section 54 in the apparatus depth direction is longer than a distance from the second sliding section 56.

The ink tubes 66 are connected to the connection adapters 58, which are attached to the carriage 22, above the arm section 46, by curving and turning back passing below the arm section 46. In addition, the first sliding section 54 is provided below the housing 44 of the carriage 22.

The distance L1 between the ink tubes 66 and the first sliding section 54 in the apparatus depth direction is shorter than the distance L2 between the first sliding section 54 and the second sliding section 56.

The ink tubes 66 are provided in a plurality, and in the ink tubes 66*a*, 66*b*, 66*c* and 66*d*, the turnback portions 68, which curve, follow the movement of the carriage 22 in the apparatus width direction. The tube diameter conversion member 64 is provided in a position that is shifted from the movement region of the turnback portions 68 in the apparatus width direction. The tube diameter of the ink tubes 60 from the ink tanks 18 to the tube diameter conversion member 64 is greater than a tube diameter of the ink tubes 66 from the tube diameter conversion member 64 to the carriage 22 through the turnback portions 68.

The ink tubes 66*a*, 66*b*, 66*c* and 66*d* are arranged in a plurality along the apparatus depth direction, and the diameter of the ink tube 66*a* that is closest to the first sliding section 54 in the apparatus depth direction is wider than the diameters of the other ink tubes 66*b*, 66*c* and 66*d*. The liquid is ink, and the ink tube 66*a* with the widest diameter supplies black ink to the recording head 32.

The ink tanks 18*a*, 18*b*, 18*c* and 18*d* are provided in a plurality along the apparatus depth direction. Among the plurality of ink tanks 18*a*, 18*b*, 18*c* and 18*d* that are provided, at least a part of the ink tank 18*a* that is positioned closest to the second sliding section 56 in the apparatus depth direction, and at least a part of the ink tube 66*a* with the widest tube diameter are in the same position in the apparatus depth direction. The ink tank 18*a* that is positioned closest to the second sliding section 56 is connected to the ink tube 66*a* with the widest tube diameter via the ink tube 60*a* and the tube diameter conversion member 64.

The printer 10 includes the tube guide member 62 that extends along the apparatus width direction, and guides the ink tubes 66*a*, 66*b*, 66*c* and 66*d*. The tube guide member 62 is arranged below the arm section 46.

The printer 10 includes the retaining member 40 that extends along the apparatus width direction, and retains the ejection driven roller 38*b*, which ejects the target recording medium. The tube guide member 62 and the retaining member 40 are separated in the apparatus height direction.

The arm section 46 extends in the lower section of the carriage 22 protruding in the apparatus depth direction from a center of the carriage 22 in the apparatus width direction, and a tip end thereof extends downward.

Second Example

An outline of a printer according to a second example is the same as the outline of the printer 10 that is described in the first example with reference to FIGS. 1 and 2. In addition, the supply pathway of the ink in the printer according to the second example is the same as the supply pathway of ink that is described in the first example with reference to FIGS. 4 to 7.

Figure 15:
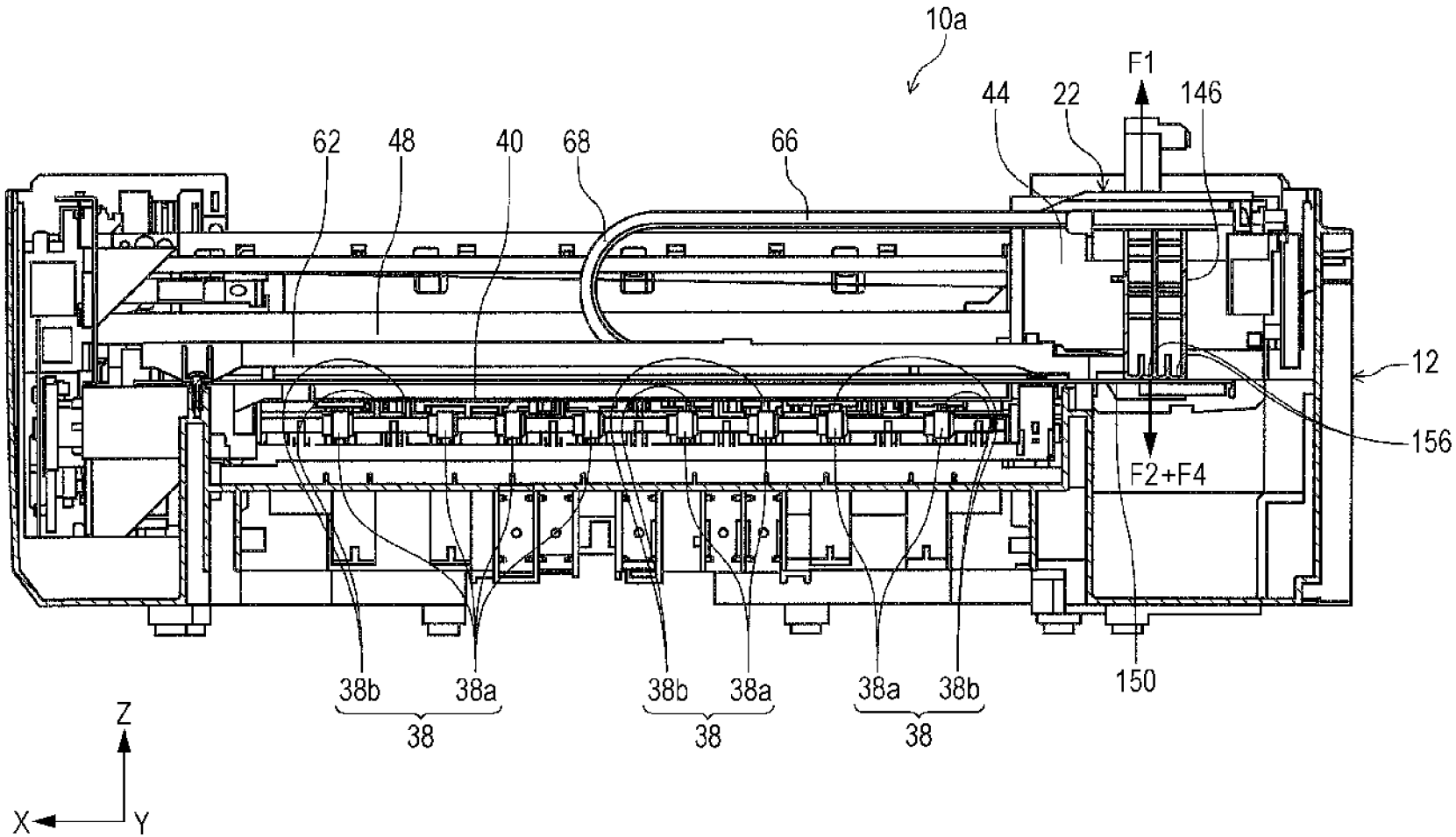
FIG. 15 is a partial cross-sectional view that shows an internal structure of a printer according to a second example.
Figure 16:
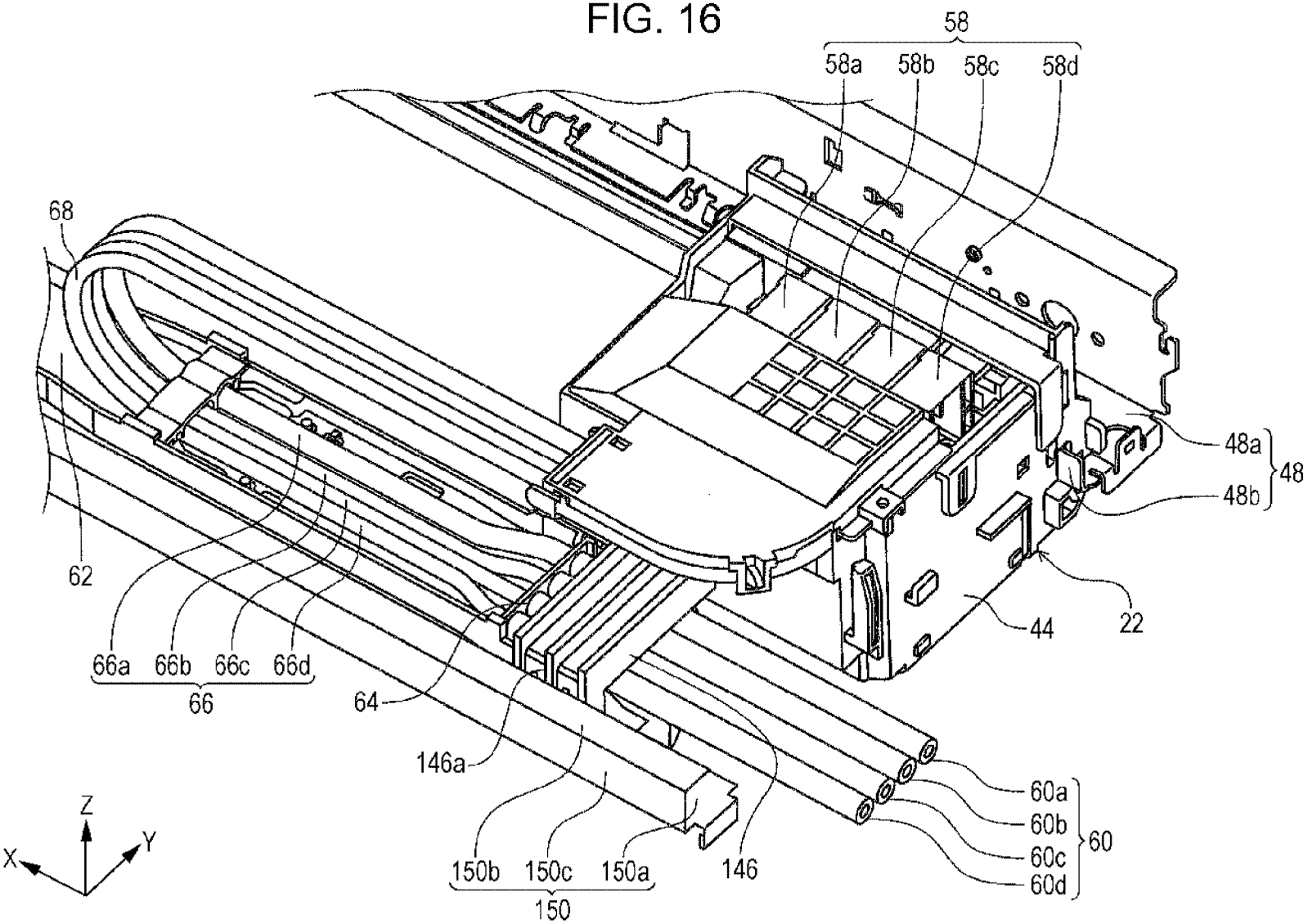
FIG. 16 is a perspective view of a carriage according to the second example.
Figure 17:
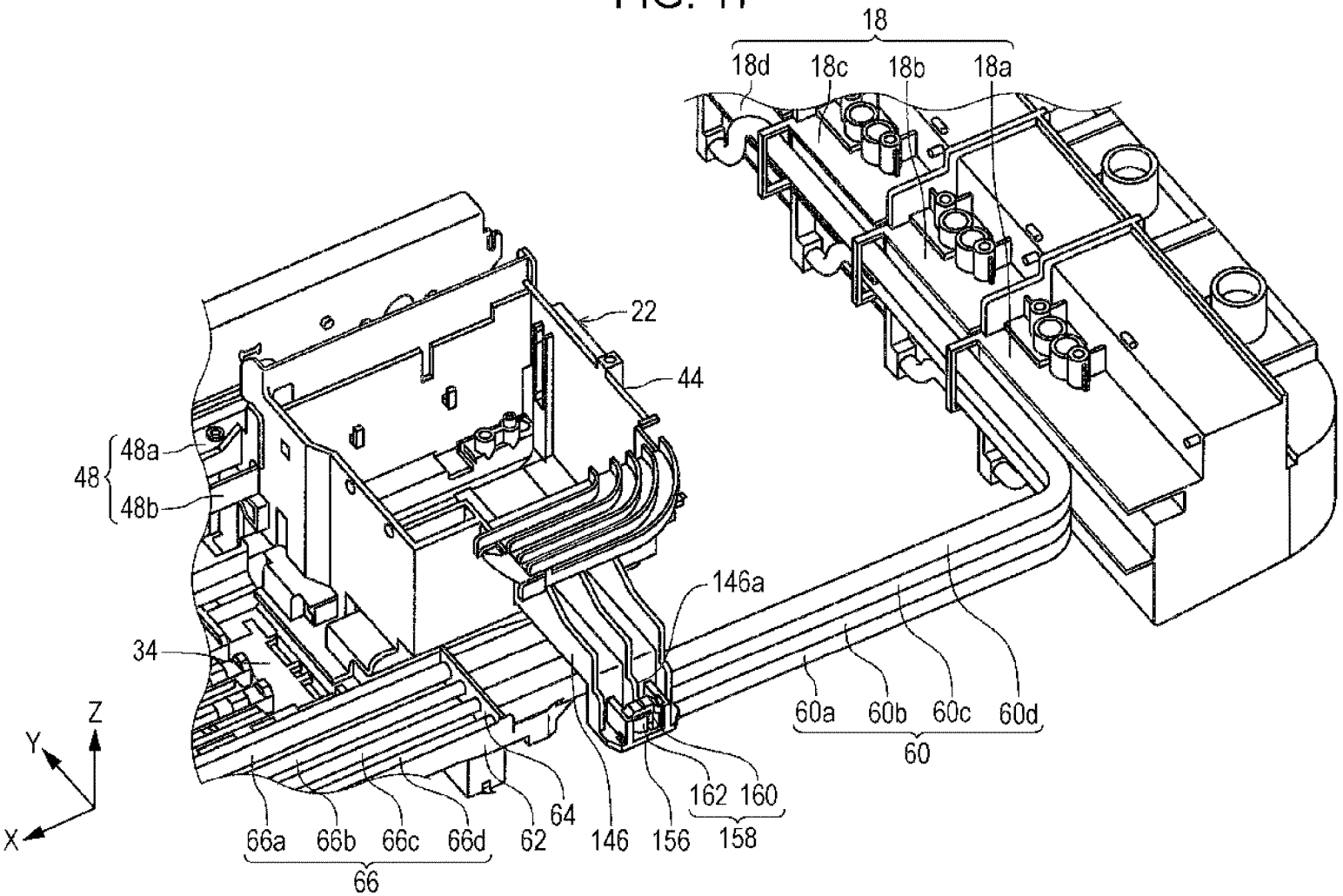
FIG. 17 is a perspective view that shows a pathway of an ink tube from an ink tank to a tube diameter conversion member according to the second example.

FIG. 15 is a partial cross-sectional view that shows an internal structure of a printer 10*a* according to the second example, FIG. 16 is a perspective view of a carriage according to the second example, and FIG. 17 is a perspective view that shows a pathway of an ink tube from an ink tank to a tube diameter conversion member.

Figure 18:
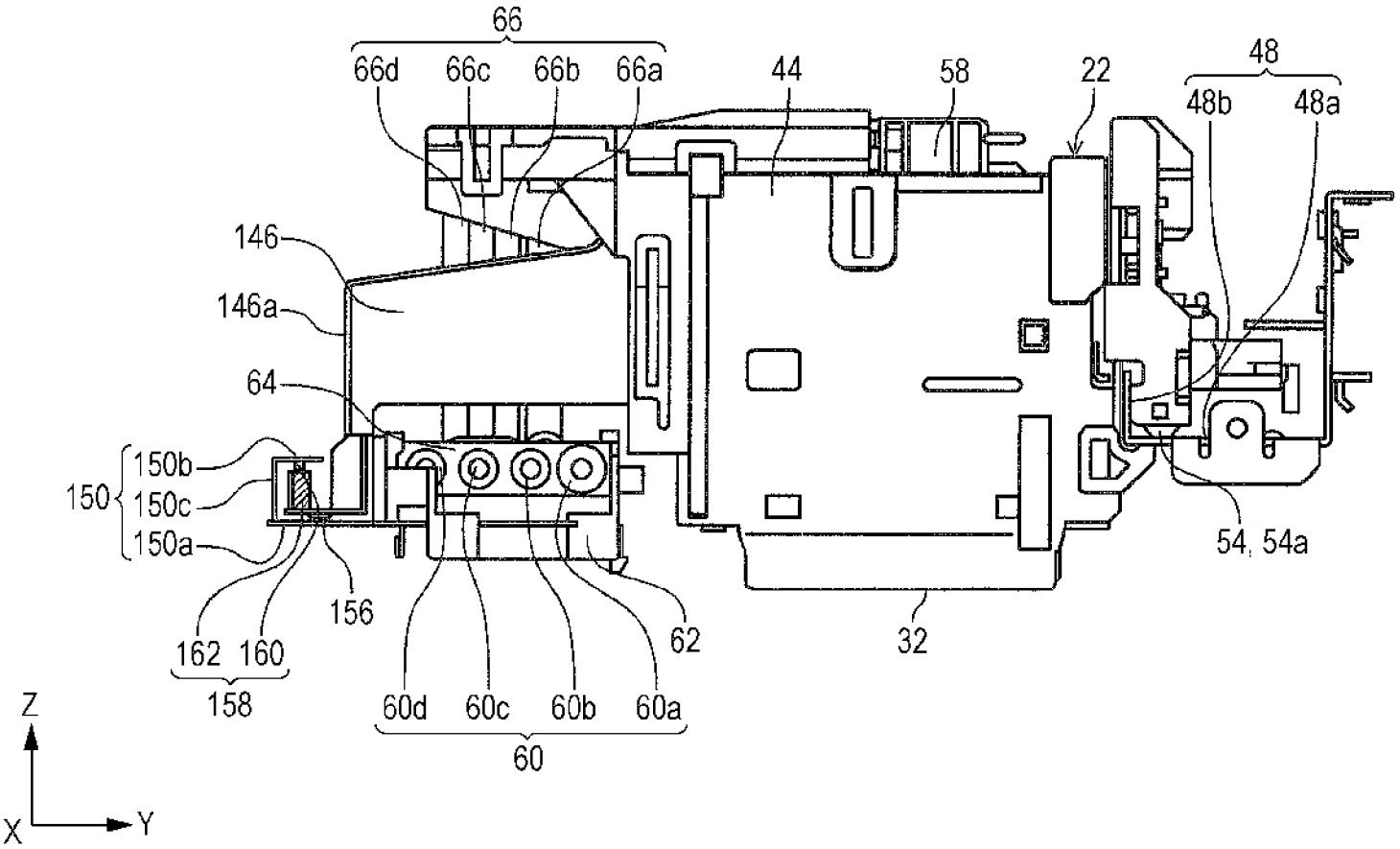
FIG. 18 is a side view of the carriage according to the second example.
Figure 19A:
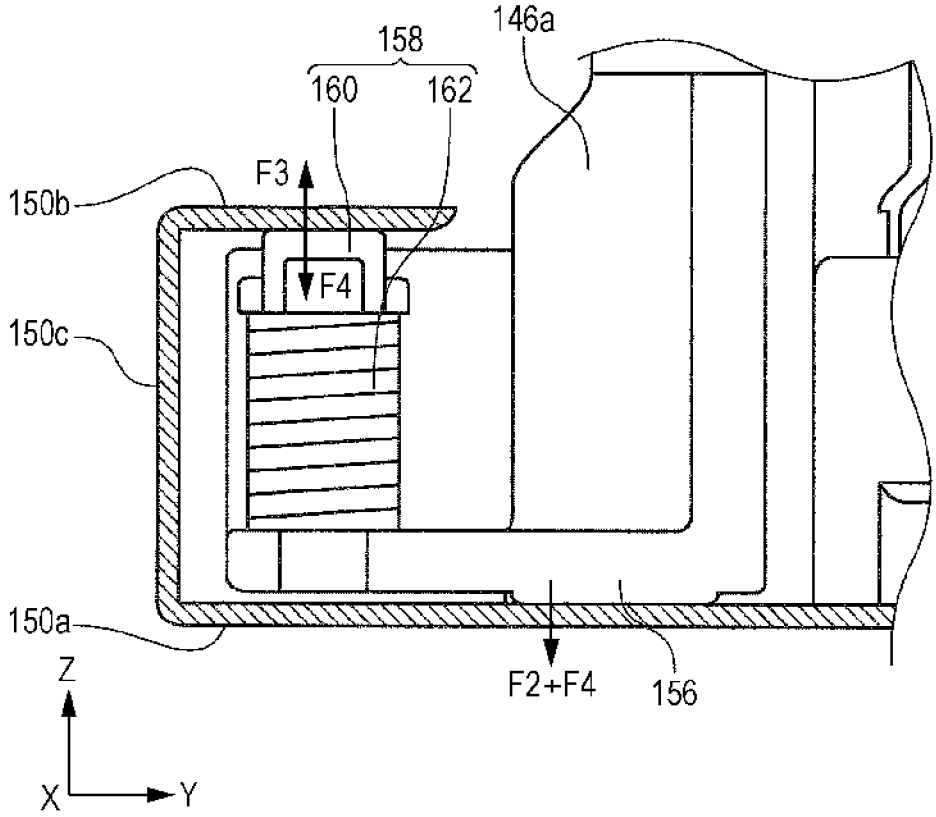
FIG. 19A is a partial cross-sectional view of regulation unit according to the second example.
Figure 19B:
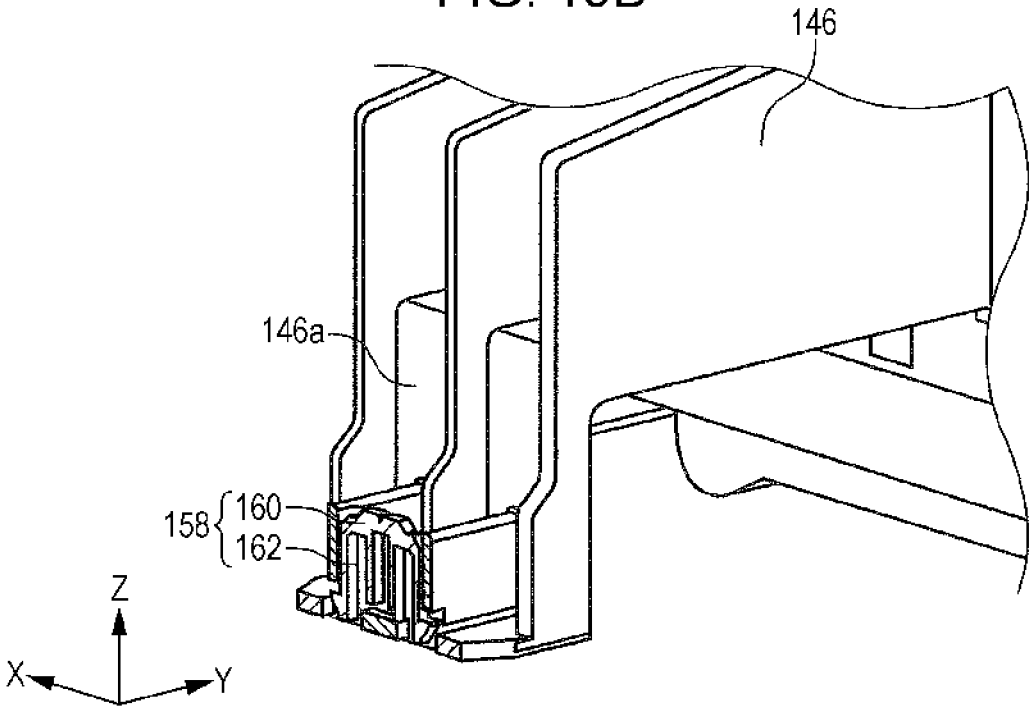
FIG. 19B is a partial perspective view of the regulation unit according to the second example.
Figure 20:
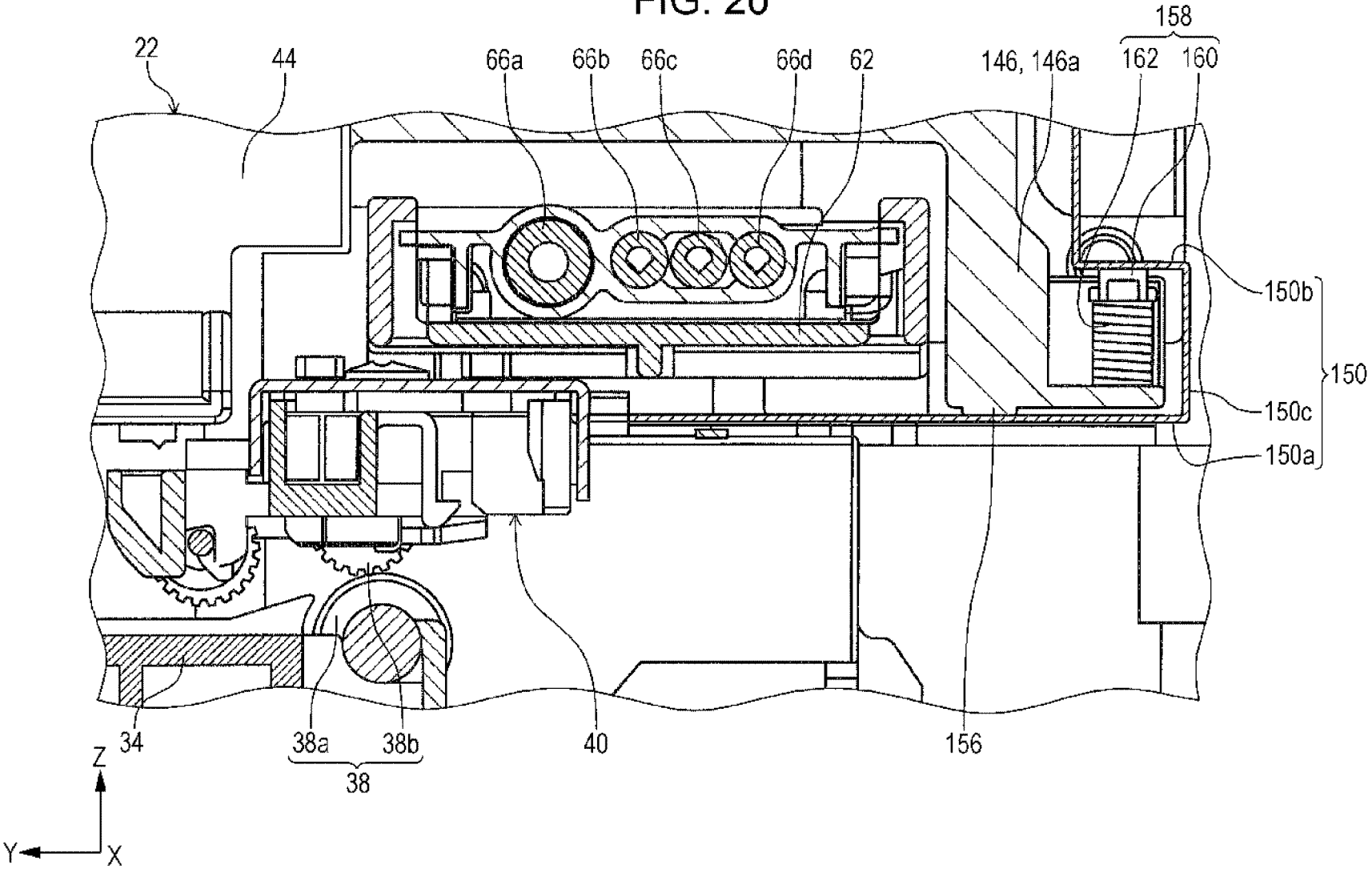
FIG. 20 is a cross-sectional view that shows a relationship between a tube guide member and a retaining member according to the second example.
Figure 23:
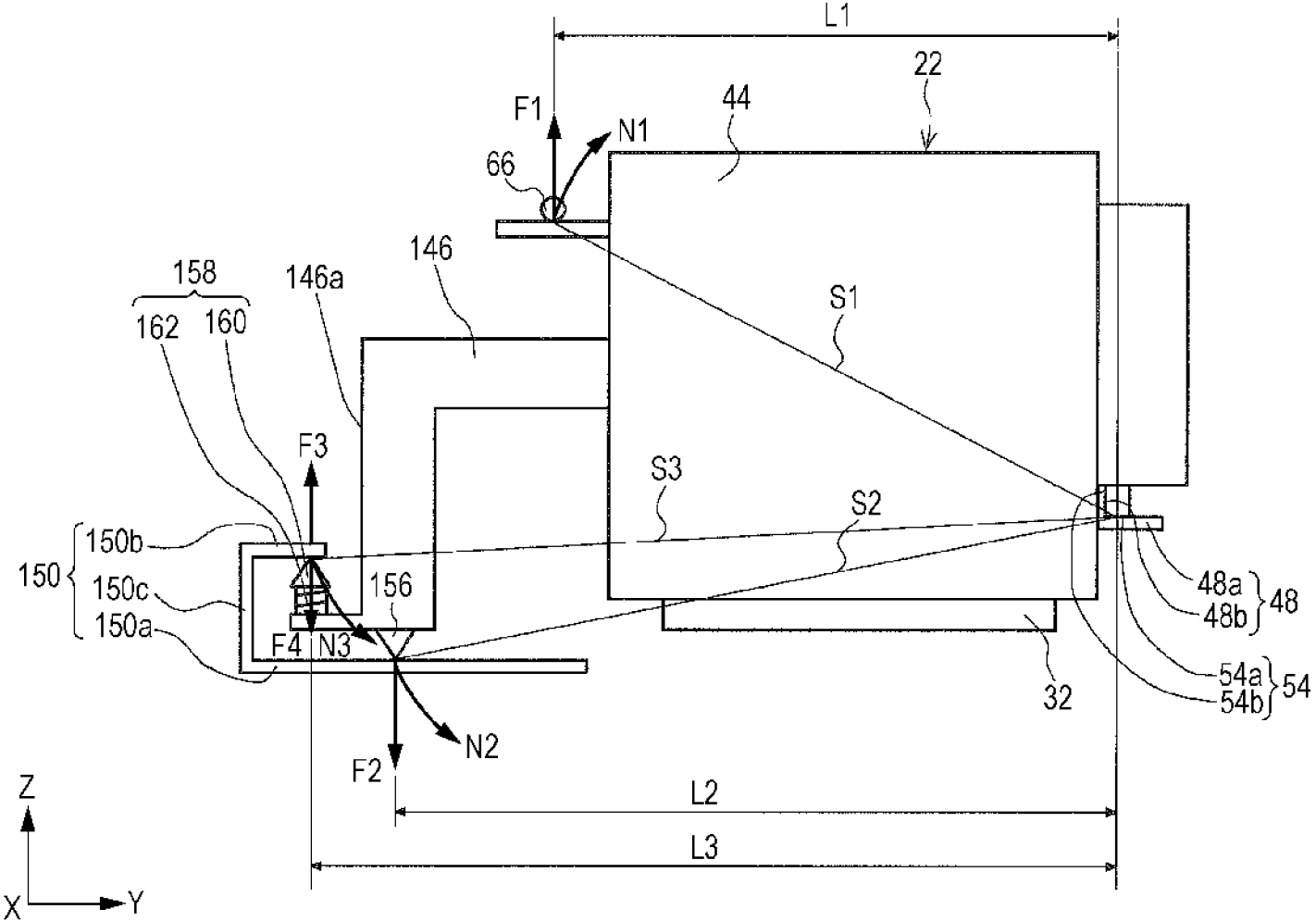
FIG. 23 is a schematic view that shows a relationship between a force and a moment in the carriage according to the second example.

FIG. 18 is a side view of the carriage according to the second example, FIG. 19A is a partial cross-sectional view of regulation unit according to the second example, FIG. 19B is a partial perspective view of the regulation unit according to the second example, FIG. 20 is a cross-sectional view that shows a relationship between a tube guide member and a retaining member, and FIG. 23 is a schematic view that shows a relationship between a force and a moment in the carriage according to the second example.

Outline of Carriage

Next, an outline of a carriage 22 will be described. As can be seen with reference to FIGS. 16, 17 and 18, the carriage 22 is provided with a box-shaped housing 44, an arm section 146 that protrudes from the housing 44 on the apparatus front surface side in the apparatus depth direction, and a recording head 32 that is provided in a bottom section of the housing 44 (refer to FIG. 18).

In addition, the carriage 22 is configured to be capable of reciprocating motion in the apparatus width direction inside the apparatus main body 12. More specifically, as shown in FIG. 16, a first guide member 48 that extends in the apparatus width direction, and a second guide member 150 that is disposed on the apparatus front surface side at a distance from the first guide member 48 in the apparatus depth direction, and extends in the apparatus width direction, are attached to the apparatus main body 12. In the present example, the first guide member 48 and the second guide member 150 are configured as guide rails.

As shown in FIGS. 16, 18 and 19A, the second guide member 150 is provided with a flat support section 150*a* that extends in the apparatus width direction, a facing section 150*b* that is positioned above the support section 150*a* in the apparatus height direction, and faces the support section 150*a*, and a connection section 150*c* that extends from the support section 150*a* in the apparatus height direction, and joins the support section 150*a* and the facing section 150*b*.

Regulation Unit

As shown in FIGS. 17 and 18, the arm section 146 protrudes from the housing 44 on the apparatus front surface side, and extends downward at a tip end of a portion that protrudes, that is, toward the second guide member 150. Further, a second sliding section 156, which comes into contact with the support section 150*a* of second guide member 150, is provided in the arm section 146.

In other words, the carriage 22 is supported by the second guide member 150 through the second sliding section 156. Accordingly, the carriage 22 is supported by the first guide member 48 through the first sliding section 54 in the apparatus height direction, and is supported by the second guide member 150 through the second sliding section 156.

In addition, regulation unit 158 area provided in the in an end section 146*a* on a front surface side in apparatus depth direction of the arm section 146. In the present example, the regulation unit 158 is provided with a slider member 160 as a "third sliding section", and a spring 162 as a "biasing member".

The slider member 160 is attached to the end section 146*a* in a manner in which the slider member 160 is capable of being displaced along the apparatus height direction at the end section 146*a* of the arm section 146. In addition, the spring 162 is disposed between the slider member 160 and the end section 146*a* of the arm section 146. The spring 162 biases the slider member 160 upward in the apparatus height direction. More specifically, the spring 162 biases the slider member 160 toward the facing section 150*b* of the second guide member 150. Further, the slider member 160 applies a pressing force to the facing section 150*b*.

In other words, the regulation unit 158 regulates a circumstance in which the second sliding section 156 of the carriage 22 attempts to become separated from the support section 150*a* of the second guide member 150 toward the apparatus height direction. Accordingly, the regulation unit 158 can oppose a moment force that has the first sliding section 54 as the pivot point thereof, which will be described later, and which occurs in the carriage 22 as a result of the spring 162 applying a pressing force to the slider member 160 toward the facing section 150*b*. Additionally, a relationship between the moment force and the regulation unit 158 will be described in detail later with the pathway of ink tubes, which will be described later.

In addition, the second sliding section 156 is provided in the arm section 146. Therefore, a distance from the first sliding section 54 to the second sliding section 156 in the apparatus depth direction is longer than a distance from the first sliding section 54 to the second sliding section 156 in a case in which the second sliding section 156 is provided on the apparatus front surface side in the housing 44. As a result of this, in a case in which the height of the back surface side of the carriage 22 in the apparatus height direction is displaced by the gap adjustment means 52, an inclination angle of the recording head 32 with respect to the target recording medium that is supported on the medium support member 34, is small. Accordingly, it is possible to suppress deteriorations in the recording quality on the target recording medium.

In addition, as can be seen with reference to FIGS. 15 to 17 and 18, a tube guide member 62 that extends in the apparatus width direction is provided in the apparatus main body 12 above the support section 150*a* of the second guide member 150. The tube guide member 62 is arranged in parallel with the facing section 150*b* of the second guide member 150 in the apparatus depth direction. Further, in the present example, the tube guide member 62 is disposed so as to pass below the arm section 146 between a front surface of the housing 44 and the end section 146*a* of the arm section 146 in the apparatus depth direction.

In addition, as shown in FIGS. 16 and 18, the tube guide member 62 is provided between the first sliding section 54 and the second sliding section 156 in the apparatus depth direction, or more specifically, between an end section on the apparatus front surface side of the housing 44 of the carriage 22 and the second sliding section 156. In other words, the ink tubes 60, which extend out from the ink tanks 18, and the ink tubes 66, extend in the apparatus width direction passing below the arm section 146 between the first sliding section 54 and the second sliding section 156 in the apparatus depth direction.

Relationship Between Moment Force in Carriage and Regulation Unit

In this instance, a force and a moment that act on the carriage 22 will be described with reference to FIG. 23. Additionally, FIG. 23 is a schematic view that shows a relationship between a force and a moment that act on the carriage 22. Additionally, in FIG. 23, only a single ink tube 66 is illustrated for purposes of description.

As shown in FIG. 23, the inverted section 48*b* of the first guide member 48 on the back surface side of the carriage 22 in the apparatus depth direction, is in a state of being inserted between the inverted sliding site 54*b* of the first sliding section 54 and the housing 44 of the carriage 22. Further, on a front surface side of the carriage 22 in the apparatus depth direction, since the second sliding section 156 is only supported from below by the second guide member 150, it is easy for the carriage 22 to rotate in a clockwise direction in FIG. 24 with the first sliding section 54 as a pivot point thereof.

In addition, a restoring force F1 that attempts to make a curve gentle, or on other words, attempts to restore the ink tube 66 to a state of being extended in a straight manner, occurs in the ink tube 66. Further, the restoring force F1 acts on the carriage 22, which the ink tube 66 is connected to, and, for example, attempts to separate the first sliding section 54 and the second sliding section 156 from the first guide member 48 and the second guide member 150 by lifting the carriage 22 up.

Since the restoring force F1 acts on the apparatus anterior surface side of the housing 44 of the carriage 22, a rotational moment force N1, which attempts to rotate the carriage 22 in the clockwise direction in FIG. 23 with the first sliding section 54 as the pivot point thereof, occurs in the carriage 22. In this instance, the rotational moment force N1 is the product of the length of a segment S1, which links the first sliding section 54 and the ink tube 66 with a straight line, and a component of the restoring force F1 that is orthogonal to the segment S1.

However, since the description thereof is complicated, in the present example, the product of the distance L1 from the first sliding section 54 to the ink tube 66 and the restoring force F1 is set as the rotational moment force N1. In the same manner a rotational moment force N2 in the second sliding section 156 and a rotational moment force N3 in the regulation unit 158, which will be described later, are also set as moment forces that are determined using distances L2 and L3 in the apparatus depth direction instead of a distance of a segment S2 that links the first sliding section 54 and the second sliding section 156, and a distance of a segment S3 that links the first sliding section 54 and the regulation unit 158. Additionally, since it is possible to reduce the effect of the position of a center of gravity by taking a load (the restoring force F1, a dead weight F2, and a reaction force F4) into consideration, consideration of the position of the center of gravity is omitted.

Accordingly, the rotational moment force N1 has a relationship N1=F1×L1. As a result of this, the rotational moment force N1 becomes proportionately larger with the distance L1 from the first sliding section 54 to the ink tube 66.

Meanwhile, the dead weight F2 of the carriage 22 acts on the second sliding section 156 in a downward manner in the apparatus height direction, or in other words, toward the second guide member 150. That is, the second sliding section 156 applies a pressing force to the second guide member 150 using the dead weight F2 of the carriage 22. In this instance, since the dead weight F2 acts on a side of the second sliding section 156 that is opposite to a side on which the restoring force F1 acts, the rotational moment force N2 acts on the second sliding section 156 toward a direction that is opposite to that of the rotational moment force N1.

In this instance, the rotational moment force N2 is represented by the product of the dead weight F2 of the carriage 22 and the distance L2 from the first sliding section 54 to the second sliding section 156. In other words, the rotational moment force N2 has a relationship of N2=F2×L2.

In addition, as shown in FIG. 23, the slider member 160 is biased against the facing section 150*b* of the second guide member 150 by a biasing force F3 due to the spring 162. As a result of this, the slider member 160 is subjected to the reaction force F4, which is the same size as the biasing force F3, from the facing section 150*b*. In other words, the arm section 146 of the carriage 22 is subjected to the reaction force F4.

In this instance, a distance in the apparatus depth direction between the first sliding section 54 and the slider member 160 is set as L3. In addition, since the reaction force F4 acts on a side of the second sliding section 156 that is opposite to a side on which the restoring force F1 acts, the rotational moment force N3 acts on the slider member 160, and furthermore, the tip end of the arm section 146 toward a direction that is opposite to that of the rotational moment force N1.

In this instance, the rotational moment force N3 is represented by the product of the reaction force F4, which the slider member 160 is subjected to, and the distance L3 from the first sliding section 54 to the slider member 160. In other words, the rotational moment force N3 has a relationship of N3=F4×L3.

Additionally, in the present example, since the ink tube 66 extends in the apparatus width direction between the first sliding section 54 and the second sliding section 156 in the apparatus depth direction, the distance L1 from the first sliding section 54 to the ink tube 66 in the apparatus depth direction is shorter than the distance L2 from the first sliding section 54 to the second sliding section 156. In other words, the distance L2 from the first sliding section 54 to the second sliding section 156 is in a relationship of L2>L1 with respect to the distance L1 from the first sliding section 54 to the ink tube 66.

In addition, as shown in FIG. 23, since the slider member 160 is positioned further on the front surface side (the −Y axis direction side in FIG. 23) in the apparatus depth direction than the second sliding section 156, the distance L3 from the first sliding section 54 to the slider member 160 has a relationship of L3>L2 with respect to the distance L2 from the first sliding section 54 to the second sliding section 156. In other words, the distances L1, L2 and L3 have a relationship of L3>L2>L1.

If the abovementioned description is summarized, in the carriage 22, the rotational moment force N1 acts in the clockwise direction in FIG. 23, and the rotational moment forces N2 and N3 act in the anticlockwise direction in FIG. 23. In this instance, considering the loads (the restoring force F1, the dead weight F2, and the reaction force F4) of the rotational moment forces N1, N2 and N3, since the distances L1, L2 and L3 have the relationship of L3>L2>L1, the rotational moment forces N1, N2 and N3 have a relationship of N2+N3>N1. As a result of this, since the rotational moment forces N2+N3 is greater than the rotational moment force N1, it is possible to suppress the separation of the second sliding section 156 from the second guide member 150.

If the abovementioned description is summarized, the regulation unit 158, which regulates separation of the second sliding section 156 from the second guide member 150, is provided in the printer 10*a* in the second example in the arm section 146, which extends by protruding from the carriage 22 on the front surface side in the apparatus depth direction. Accordingly, the distance L3 between the first sliding section 54 and the regulation unit 158 in the apparatus depth direction is long, and it is even possible to counter the rotational moment force N1 that occurs in the carriage 22 with a small force. As a result of this, the regulation unit 158 can easily suppress the separation of the second sliding section 156 from the second guide member 150. As a result of this, since the posture of the recording head 32, and furthermore, the carriage 22 with respect to the target recording medium is stabilized, it is possible to suppress deteriorations in the recording quality on the target recording medium.

In addition, since the second sliding section 156 is provided in the arm section 146, the regulation unit 158 can reliably regulate a circumstance in which the second sliding section 156 becomes separated from the second guide member 150 in the vicinity of the second sliding section 156. Therefore, since the posture of the recording head 32, and furthermore, the carriage 22 is stabilized with respect to the target recording medium, it is possible to suppress deteriorations in the recording quality on the target recording medium.

In addition, in the regulation unit 158, the slider member 160, which is the third sliding section, comes into contact with the facing section 150*b*. In other words, the regulation unit 158 regulates displacement of the carriage 22 with respect to a direction in which the second sliding section 156 becomes separated from the support section 150*a* of the second guide member 150 with the first sliding section 54 as a pivot point thereof, by causing the slider member 160 to come into contact with the facing section 150*b*. Accordingly, since the regulation unit 158 can more reliably counter the rotational moment force N1, and the posture of carriage 22 is stabilized as a result, it is possible to suppress deteriorations in the recording quality on the target recording medium.

In addition, the regulation unit 158 is provided with the spring 162, which biases the slider member 160 toward the facing section 150*b*. In other words, since the spring 162 biases the slider member 160 toward the facing section 150*b*, the slider member 160 is subjected to the reaction force F4 from the facing section 150*b*, which acts in a direction that is opposite to a direction in which the rotational moment force N1 acts. Accordingly, since the reaction force F4 in the carriage 22 acts in a direction in which the rotational moment force N1 decreases, the regulation unit 158 reliably stabilizes the posture of the carriage 22, and therefore, it is possible to suppress deteriorations in the recording quality on the target recording medium.

In addition, in the present example, the ink tubes 66 extend in the apparatus width direction between the first sliding section 54 and the second sliding section 156 in the apparatus depth direction. Accordingly, the distance L1 from the first sliding section 54 to the ink tubes 66 in the apparatus depth direction is shorter than the distance L3 from the first sliding section 54 to the regulation unit 158. In other words, the distance L3 from the first sliding section 54 to the regulation unit 158 in the apparatus depth direction is longer than a radius L1 of the rotational moment force N1, which acts on the carriage 22. Accordingly, the regulation unit 158 can counter the rotational moment force N1 with a smaller force.

In addition, in the present example, since the ink tubes 66 are connected to the connection adapters 58, which are attached to the carriage 22, above the arm section 146, by curving and turning back passing below the arm section 146, it is possible to make a curvature radius of a turnback portion 68 of the ink tube 66 greater. As a result of this, it is possible to reduce the restoring force F1 that attempts to make the curve, which occurs in the ink tube 66, gentle. As a result of this, it is possible to more reliably suppress a circumstance in which the restoring force F1 resists the dead weight F2 of the carriage 22 and attempts to separate the carriage 22 from the first guide member 48 or the second guide member 150. Therefore, it is possible to suppress deteriorations in the recording quality on the target recording medium as a result.

In addition, as shown in FIG. 23, the distance L1 from the first sliding section 54 to the ink tubes 66 in the apparatus depth direction is shorter than the distance L2 from the first sliding section 54 to the second sliding section 156. Accordingly, it is possible to reduce the rotational moment force N1, which occurs in the carriage 22, beyond the rotational moment force N2 due to the dead weight F2 of the carriage 22, which acts on the second sliding section 156. As a result of this, it is possible to suppress a circumstance in which the carriage 22 attempts to become separated from the second guide member 150. Therefore, it is possible to suppress deteriorations in the recording quality on the target recording medium as a result.

As shown in FIG. 18, in the present example, among the ink tubes 66*a*, 66*b*, 66*c* and 66*d*, which are arranged in a plurality in the apparatus depth direction, the ink tube 66*a*, which is arranged closest to the first sliding section 54, is wider than the other ink tubes 66*b*, 66*c* and 66*d*. In this instance, the restoring force F1 that attempts to make the curve, which occurs in the turnback portion 68 of the ink tubes 66, gentle becomes larger as the diameters of the ink tubes 66 become wider. Accordingly, in the present example, the ink tube 66*a*, which has the largest restoring force F1, is disposed close to the first sliding section 54, but since it is possible to make the distance L1 between the ink tube 66*a*, which has the largest restoring force F1, and the first sliding section 54 smaller, it is possible to reduce the moment force N1 that attempts to rotate the carriage 22 with the first sliding section 54 as the pivot point thereof. Accordingly, it is possible to suppress a circumstance in which the carriage 22 attempts to become separated from the second guide member 150. Therefore, it is possible to suppress deteriorations in the recording quality on the target recording medium as a result.

In addition, as shown in FIGS. 17 and 18, among the ink tanks 18*a*, 18*b*, 18*c* and 18*d*, at least a part of the ink tank 18*a*, which is positioned closest to the second sliding section 156 along the apparatus depth direction, and at least a part of the ink tube 66*a*, which has the widest tube diameter, are in the same position in the apparatus depth direction. Further, the ink tank 18*a*, which is disposed closest to the second sliding section 156 is connected to the ink tube 66*a*, which has the widest tube diameter, through the ink tube 60*a* and the tube diameter conversion member 64.

In other words, the distance in the apparatus depth direction between the ink tank 18*a*, which is positioned closest to the second sliding section 156, and the ink tube 66*a*, which has the widest tube diameter, can be said to be shorter than the distances between the other ink tanks 18*b*, 18*c* and 18*d*, and the other ink tubes 66*b*, 66*c* and 66*d*. Accordingly, in the ink tubes 60*a*, 60*b*, 60*c* and 60*d*, which are connected to the tube diameter conversion member 64 by changing toward the apparatus width direction after extending out in the apparatus depth direction from each ink tank 18*a*, 18*b*, 18*c* and 18*d*, it is possible to make the pathway length of the ink tube 60*a* the shortest.

As a result of this, it is possible to make the pathway length in the ink tubes 60*a* and 66*a*, which have the widest tube diameters, from the ink tank 18*a*, which is positioned closest to the second sliding section 156, to the carriage 22 shorter than the pathway lengths in the other ink tubes 60*b*, 60*c*, 60*d*, 66*b*, 66*c* and 66*d* from the ink tanks 18*b*, 18*c* and 18*d* to the carriage 22.

In addition, as can be seen with reference to FIGS. 15 and 20, the tube guide member 62 is provided in a state of being separated from the retaining member 40, which retains the ejection driven roller 38*b* in a manner in which the ejection driven roller 38*b* is capable of rotating, in the apparatus height direction.

In the present example, since the tube guide member 62 and the retaining member 40 are separated, the retaining member 40 is not subjected to the restoring force F1, which attempts to make the curve that occurs in the ink tubes 66 gentle, via the tube guide member 62, and therefore, it is possible to suppress a circumstance in which the retaining member 40 becomes warped as a result of being subjected to the restoring force F1. As a result of this, since it is possible to suppress a circumstance in which the retaining member 40 becomes warped, it is possible to suppress deteriorations in an ejection property of the target recording medium since it is difficult for positional shift of the ejection driven roller 38*b* due to warping of the retaining member 40 to occur.

Modification Examples of Second Example (1) In the present example, a configuration in which the ink tubes 66 and the tube guide member 62 pass below the arm section 146, is used, but in place of this configuration, the ink tubes 66 and the tube guide member 62 may be disposed so as to pass above the arm section 146.

(2) In addition, in the present example, a configuration in which the ink tubes 66 pass below the arm section 146, which protrudes from the carriage 22, is used, but in place of this configuration, a configuration in which the second sliding section 156 is provided in a lower section of the housing 44 of the carriage 22 on the apparatus front surface side in a state in which the regulation unit 158 is provided in the end section 146*a* of the arm section 146, and the ink tubes 66 pass between the first sliding section 54 and the second sliding section 156 in the lower section of the housing 44, may be used.

(3) In addition, in the present example, the tube diameter of the ink tubes 60 and 66 is converted by the tube diameter conversion member 64, but in place of this configuration, the rigidity of the ink tubes 60 and 66 may be changed.

(4) In the present example, a configuration in which the flat sliding site 54*a* and the inverted sliding site 54*b* of the first sliding section 54 slide on the first guide member 48, which includes the flat section 48*a* and the inverted section 48*b*, is used, but in place of this configuration, the first guide member 48 may be an axial member.

Third Example

Figure 21:
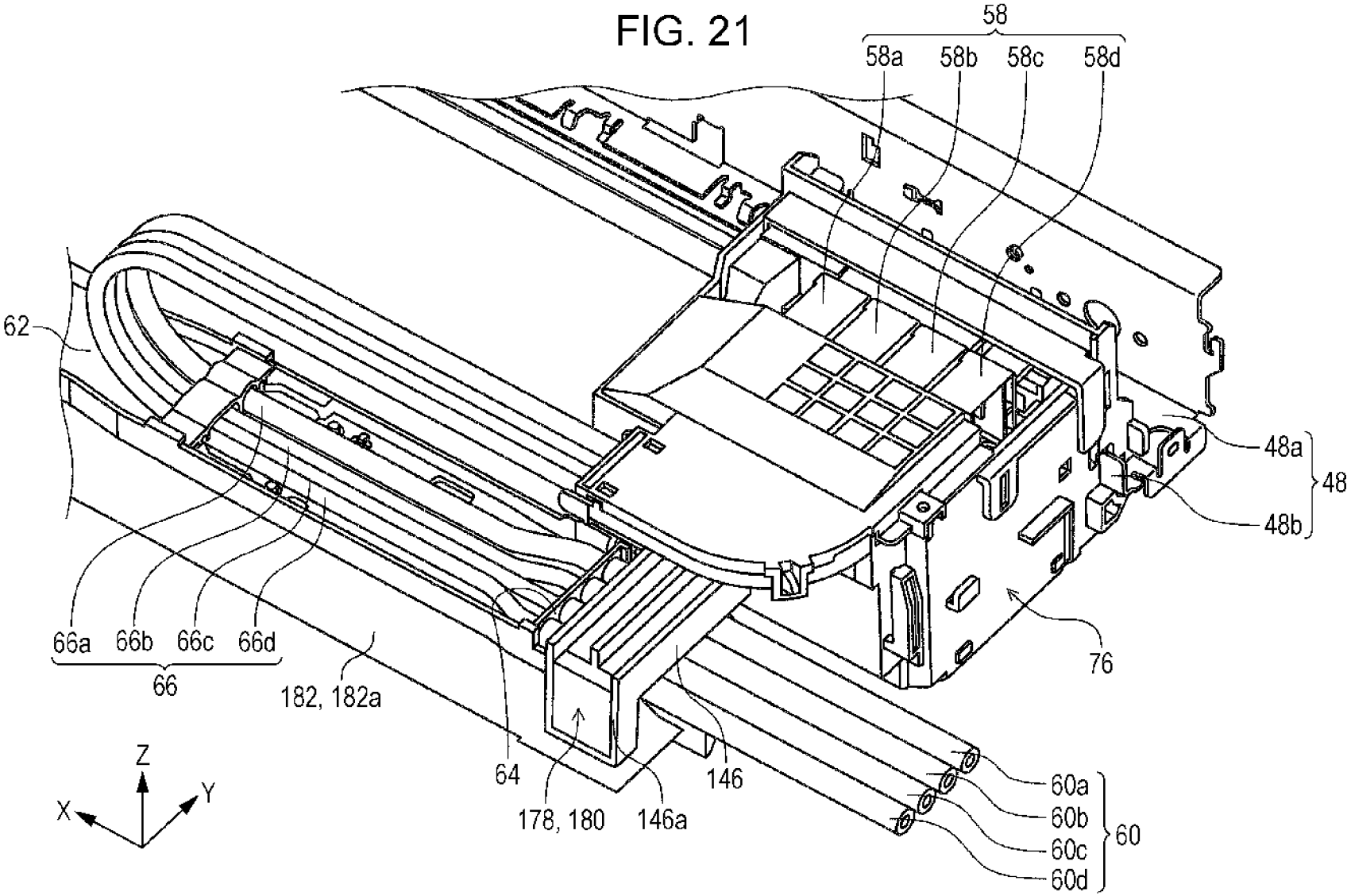
FIG. 21 is a perspective view of a carriage according to a third example.
Figure 22:
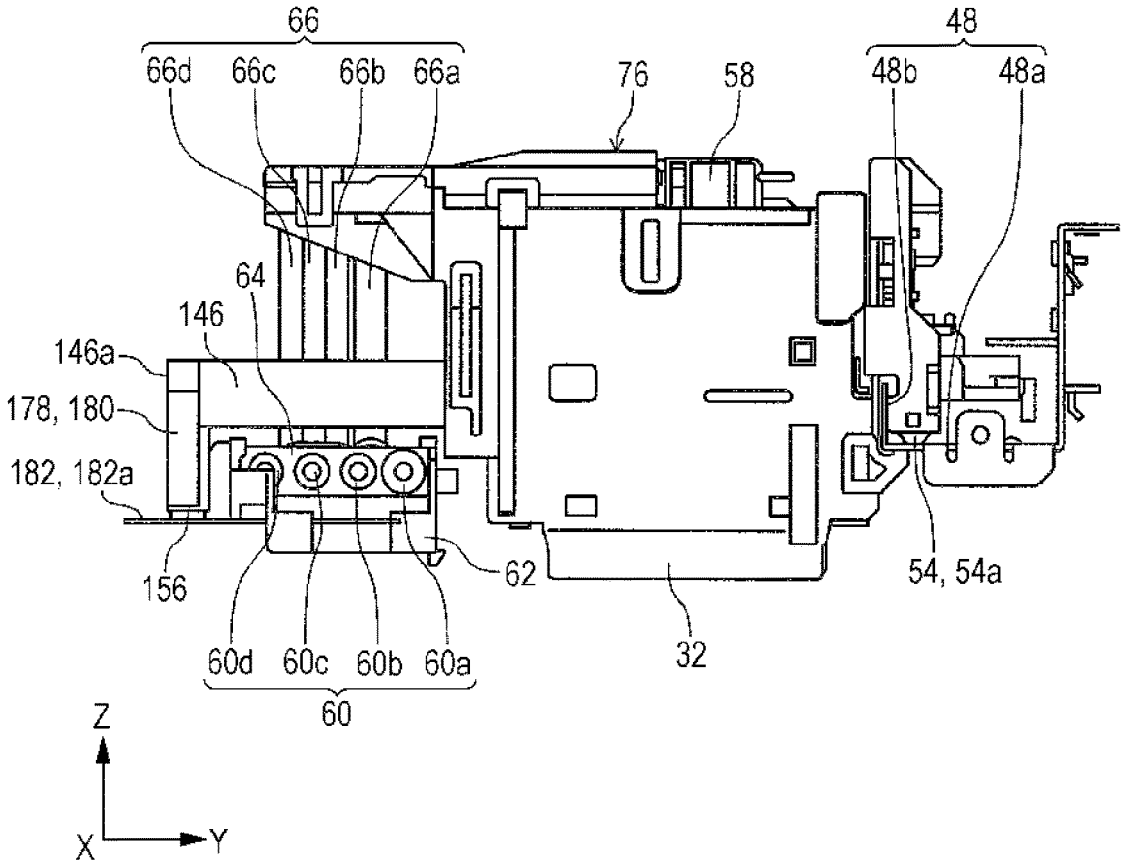
FIG. 22 is a side view of the carriage according to the third example.
Figure 24:
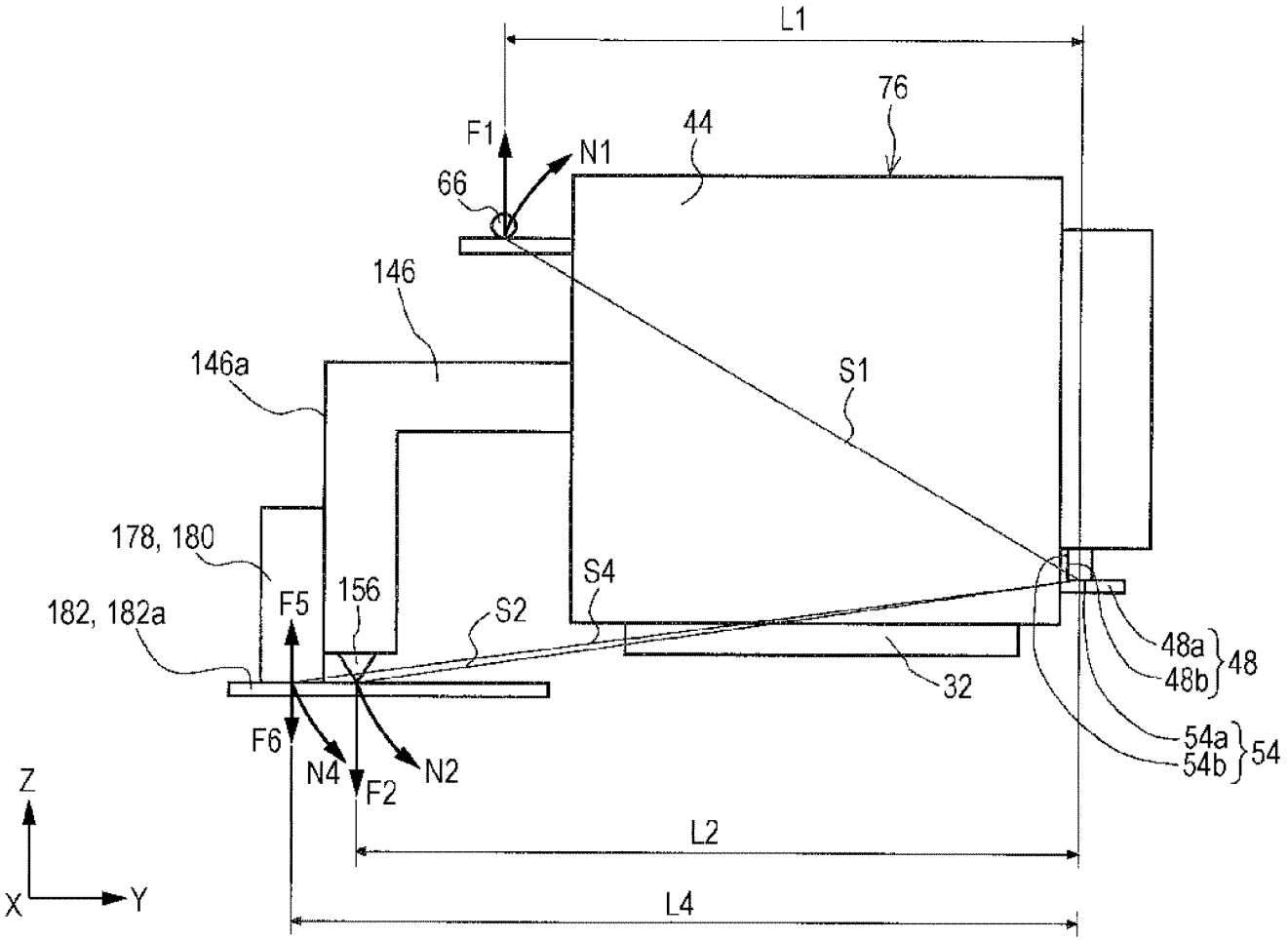
FIG. 24 is a schematic view that shows a relationship between a force and a moment in the carriage according to the third example.

FIG. 21 is a perspective view of a carriage according to a third example, FIG. 22 is a side view of the carriage according to the third example, and FIG. 24 is a schematic view that shows a relationship between a force and a moment in the carriage according to the third example.

A carriage 76 according to a third example will be described with reference to FIGS. 21 and 22. The present example differs from the second example in that a regulation unit 178 is provided with a magnetic member 180 in place of the slider member 160 and the spring 162. Additionally, other configurations are the same as the configurations of the second example, and therefore description thereof will be omitted. Additionally, since it is possible to reduce the effect of the position of a center of gravity by taking a load (the restoring force F1, a dead weight F2, and a reaction force F6) into consideration, consideration of the position of the center of gravity is omitted.

In the present example, a second guide member 182 is configured as a flat plate member that is provided with a support section 182*a*. In addition, in the present example, the second guide member 182 is configured by a magnetic material. An arm section 146 is provided on the apparatus front surface side of the carriage 76, and the regulation unit 178 is provided at an end section 146*a* on a tip end side (the apparatus front surface side) of the arm section 146.

In the present example, the regulation unit 178 is provided with a magnetic member 180. The magnetic member 180 is configured as a magnet as an example. As shown in FIG. 22, the second sliding section 156 is provided in the arm section 146 of the carriage 76. In the present example, the second sliding section 156 is biased toward the support section 182*a* of the second guide member 182 by the dead weight of the carriage 76. In the present example, the second sliding section 156 is in a state of coming into contact with the support section 182*a* of the second guide member 182.

In the present example, since the magnetic member 180 is provided at the end section 146*a* of the arm section 146, in which the second sliding section 156 is provided, the magnetic member 180 is in a position that is close to the second guide member 182. As a result of this, the magnetic member 180 draws the second guide member 182 to a magnetic member 180 side by the magnetic force. As a result of this, the second guide member 182 is drawn to the magnetic member 180 side, a second sliding section 156 side in the present example, by the magnetic force of the magnetic member 180. Accordingly, the magnetic force of the magnetic member 180 acts in a direction that prevents separation of the second sliding section 156 from the second guide member 182.

Furthermore, a relationship between a force and a rotational moment force that act on the carriage 76 will be described with reference to FIG. 24. The rotational moment forces N1 and N2 are the same as those of first example, and therefore description thereof will be omitted. The magnetic member 180 draws the second guide member 182 to the second sliding section 156 side using a magnetic force F5. If the second guide member 182 is displaced in a direction of becoming separated from the magnetic member 180, a reaction force F6, which is the same size as the magnetic force F5, acts on the magnetic member 180, and furthermore, the carriage 76.

In addition, in the present example, a rotational moment force N4 in the regulation unit 178 is also set as a moment force that is determined using a distance L4 in the apparatus depth direction instead of a distance of a segment S4 that links the first sliding section 54 and the regulation unit 178.

In this instance, since the reaction force F6 acts on a side of the second sliding section 156 that is opposite to a side on which the restoring force F1 acts, the rotational moment force N4 acts on the arm section 146, and furthermore, the carriage 76 toward a direction that is opposite to that of the rotational moment force N1.

The rotational moment force N4 is represented by the product of the reaction force F6, which the carriage 76 is subjected to, and the distance L4 from the first sliding section 54 to the magnetic member 180. In other words, the rotational moment force N4 has a relationship of $N4=F6\times L4$.

In addition, as shown in FIG. 24, since the magnetic member 180 is positioned further on the front surface side (the −Y axis direction side in FIG. 24) in the apparatus depth direction than the second sliding section 156, the distance L4 from the first sliding section 54 to the magnetic member 180 has a relationship of $L4>L2$ with respect to the distance L2 from the first sliding section 54 to the second sliding section 156. In other words, the distances L1, L2 and L4 have a relationship of $L4>L2>L1$.

If the abovementioned description is summarized, in the carriage 76, the rotational moment force N1 acts in the clockwise direction in FIG. 24, and the rotational moment forces N2 and Rotational moment force N4 act in the anticlockwise direction. In this instance, considering the loads (the restoring force F1, the dead weight F2, and the reaction force F6) of the rotational moment forces N1, N2 and N4, since the distances L1, L2 and L4 have the relationship of $L4>L2>L1$, the rotational moment forces N1, N2 and N4 have a relationship of $N2+N4>N1$. As a result of this, since the rotational moment forces N2+N4 is greater than the rotational moment force N1, it is possible to suppress the separation of the second sliding section 156 from the second guide member 150.

Modification Examples of Third Example (1) In the present example, a configuration in which the magnetic member 180 is adsorbed to the support section 182*a*, is used, but in place of this configuration, a configuration in which the magnetic member 180 and the second guide member 182 are separated in a range in which the magnetic force F5 of the magnetic member 180 acts on the second guide member 182, may also be used.

(2) In the present example, the magnetic member 180 is disposed on the apparatus front surface side of the second sliding section 156 in the apparatus depth direction, but in place of this configuration, a configuration in which the magnetic member 180 is provided below the housing 44 of the carriage 76, may be used.

If the abovementioned description is summarized, a printer in the third example is provided with the recording head 32 that performs recording by discharging ink onto a target recording medium, the carriages 22 and 76, on which the recording head 32 is provided, and which are capable of moving along the apparatus width direction, the first sliding section 54 that is provided in the carriages 22 and 76, on the apparatus back surface side in the apparatus depth direction, the second sliding section 156 that is provided in the carriages 22 and 76, in the arm section 146, which extends from the apparatus front surface side in the apparatus depth direction, protruding in the apparatus depth direction, the first guide member 48 that supports the carriages 22 and 76 by coming into contact with the first sliding section 54, and guides movement of the carriages 22 and 76, the second guide members 150 and 182 that extend in the apparatus width direction, are disposed at an interval from the first guide member 48 in the apparatus depth direction, support the carriages 22 and 76 by coming into contact with the second sliding section 156, and guide the movement of the carriages 22 and 76, the ink tanks 18 that accommodate the ink, the ink tubes 60 and 66, which are ink tubes 60 and 66 that supply the ink, which is delivered from the ink tanks 18, to the carriages 22 and 76, extend in the apparatus width direction by extending out from the carriages 22 and 76, and extend in an opposite direction by turning back in a vertical direction, and the regulation unit 158 and 178 that are provided in the arm section 146 and regulate the separation of the second sliding section 156 from the second guide members 150 and 182.

The second guide member 150 is provided with the support section 150*a* that supports by coming into contact with the second sliding section 156, and the facing section 150*b* that is positioned above the support section 150*a*, and faces the support section 150*a*. The regulation unit 158 is provided the slider member 160, which is capable of sliding in contact with the facing section 150*b*. The regulation unit 158 is provided with the spring 162, which biases the slider member 160 toward the facing section 150*b*.

The regulation unit 178 is provided with the magnetic member 180. The magnetic member 180 draws the second guide member 182 to the second sliding section 156 side using a magnetic force.

The ink tubes 60 and 66 extend in the apparatus width direction between the first sliding section 54 and the second sliding section 156 in the apparatus depth direction. The ink tubes 66 are connected to the carriages 22 and 76 above the arm section 146, by curving and turning back passing below the arm section 146. The distance L1 between the ink tubes 66 and the first sliding section 54 in the apparatus depth direction is shorter than the distance L2 between the first sliding section 54 and the second sliding section 156.

The ink tubes 66 are arranged in a plurality along the apparatus depth direction, and the diameters of the ink tubes 60*a* and 66*a* that is closest to the first sliding section 54 in the apparatus depth direction are wider than the diameters of the other ink tubes ink tubes 60*b*, 60*c*, 60*d*, 66*b*, 66*c* and 66*d*. The liquid is ink, and the ink tubes 60*a* and 66*a* with the widest diameters supply black ink to the recording head 32. The ink tanks 18*a*, 18*b*, 18*c* and 18*d* are provided in a plurality along the apparatus depth direction. Among the plurality of ink tanks 18*a*, 18*b*, 18*c* and 18*d* that are provided, at least a part of the ink tank 18*a* that is positioned closest to the second sliding section 156 in the apparatus depth direction, and at least a part of the ink tubes 60*a* and 66*a* with the widest tube diameters are in the same position in the apparatus depth direction. The ink tank 18*a* that is positioned closest to the second sliding section 156 is connected to the ink tube 60*a* with the widest tube diameter.

The printer of the third example includes the tube guide member 62 that extends along the apparatus width direction, and guides the ink tubes 60 and 66. The tube guide member 62 is arranged below the arm section 146. The printer of the third example includes the retaining member 40 that extends along the apparatus width direction, and retains the ejection driven roller 38*b*, which ejects the target recording medium. The tube guide member 62 and the retaining member 40 are separated in the apparatus height direction.

The arm section 146 extends in the lower section of the carriage 22 protruding in the apparatus depth direction from a center of the carriage 22 in the apparatus width direction, and a tip end thereof extends downward.

In addition, in abovementioned examples, the carriages 22 and 76 according to the invention are applied to an ink jet printer as an example of a recording apparatus, but it is also possible to apply the carriages 22 and 76 generally to other liquid ejecting apparatuses.

In this instance, liquid ejecting apparatuses are not limited to recording apparatuses such as printers, copy machines and facsimiles, in which an ink jet type recording head is used, and which perform recording on a target recording medium by discharging ink from the recording head, and the term includes apparatuses that attach, in place of ink, a liquid that corresponds to the application thereof, to a target ejecting medium that corresponds to a target recording medium by ejecting the liquid onto the target ejecting medium from a liquid ejecting head that corresponds to an ink jet recording head.

Other than the abovementioned recording head, examples of liquid ejecting heads include color material ejecting heads that are used in the production of color filters such as liquid crystal displays, electrode material (conductive paste) ejecting heads that are used in electrode formation such as organic EL displays and Field Emission Displays (FED), living organic material ejecting heads that are used in the production of biochips, reagent ejecting heads as precision pipettes, and the like.

Additionally, the invention is not limited to the abovementioned examples, various alterations are possible within the range of the invention that is disclosed in the claims, and, naturally, such alterations are also included within the scope of the invention.

The entire disclosure of Japanese Patent Application No. 2015-007481 filed on Jan. 19, 2015 and No. 2015-007482 filed on Jan. 19, 2015 are expressly incorporated by reference herein.

What is claimed is:

1. A recording apparatus comprising:

a recording head that performs recording by discharging a liquid onto a target recording medium;

a carriage, on which the recording head is provided, and which is capable of moving along a first direction;

a first sliding section that is provided in the carriage, on one side in a second direction, which intersects the first direction;

a second sliding section that is provided in the carriage, in an arm section, which extends from the other side in the second direction, protruding in the second direction;

a first guide member that extends in the first direction and supports the carriage by coming into contact with the first sliding section, and guides movement of the carriage;

a second guide member that extends in the first direction, is disposed at an interval from the first guide member in the second direction, supports the carriage by coming into contact with the second sliding section, and guides the movement of the carriage;

a liquid accommodation section that accommodates the liquid; and a tube that supplies the liquid, which is delivered from the liquid accommodation section, and has a moving area and a fixing area, wherein the moving area is above the arm section and the fixing area is below the arm section.

2. The recording apparatus according to claim 1, wherein the first sliding section retains the carriage in the second direction by the first guide member being inserted between the carriage and the first sliding section in the second direction, wherein the second sliding section is supported from below by the second guide member, and wherein the tube is disposed in a position at which a distance from the first sliding section in the second direction is longer than a distance from the second sliding section.

3. The recording apparatus according to claim 1, wherein the first sliding section is provided in a lower section of the carriage.

4. The recording apparatus according to claim 1, further comprising:

a regulation unit that is provided in the arm section, and regulates separation of the second sliding section from the second guide member.

5. The recording apparatus according to claim 4, wherein the second guide member further includes a support section that supports by coming into contact with the second sliding section, and a facing section that is provided above the support section, and faces the support section, and wherein the regulation unit is provided with a third sliding section that comes into contact with the facing section and is capable of sliding.

6. The recording apparatus according to claim 5, wherein the regulation unit further includes a biasing member that biases the third sliding section toward the facing section.

7. The recording apparatus according to claim 4, wherein the regulation unit further includes a magnetic member, and wherein the magnetic member draws the second guide member to a second sliding section side using a magnetic force.

8. The recording apparatus according to claim 1, wherein a plurality of the tubes are provided, wherein, in the tubes, turnback portions, which curve, follow the movement of the carriage in the first direction, wherein a tube diameter conversion member is provided in a position that is shifted from a movement region of the turnback portions in the first direction, and wherein a tube diameter from the liquid accommodation section to the tube diameter conversion member is greater than a tube diameter from the tube diameter conversion member to the carriage through the turnback portions.

9. The recording apparatus according to claim 1, wherein a plurality of the tubes are arranged along the second direction, and a diameter of a tube that is closest to the first sliding section in the second direction is greater than those of the other tubes.

10. The recording apparatus according to claim 9, wherein the liquid is ink, and wherein the tube with the widest diameter supplies black ink to the recording head.

11. The recording apparatus according to claim 9, wherein a plurality of the liquid accommodation sections are provided along the second direction, wherein, among the plurality of liquid accommodation sections that are provided, at least a part of a liquid accommodation section that is positioned closest to the second sliding section in the second direction, and at least a part of the tube with the widest tube diameter are in the same position in the second direction, and wherein the liquid accommodation section that is positioned closest to the second sliding section is connected to the tube with the widest tube diameter.

12. The recording apparatus according to claim 1, further comprising:

a tube guide member that extends along the first direction, and guides the tube, wherein the tube guide member is arranged below the arm section.

13. The recording apparatus according to claim 12, further comprising:

a retaining member that extends along the first direction, and retains an ejection roller, which ejects the target recording medium, wherein the tube guide member and the retaining member are separated.

14. The recording apparatus according to claim 1, wherein the arm section extends in a lower section of the carriage protruding in the second direction from a center of the carriage in the first direction, and a tip end thereof extends downward.

15. The recording apparatus according to claim 1, wherein a distance between the tube and the first sliding section in the second direction is shorter than the distance between the first sliding section and the second sliding section.

* * * * *